US010344631B2

(12) United States Patent
Schmitt et al.

(10) Patent No.: US 10,344,631 B2
(45) Date of Patent: Jul. 9, 2019

(54) MECHANICAL CAM PHASING SYSTEMS AND METHODS

(71) Applicant: HUSCO Automotive Holdings LLC, Waukesha, WI (US)

(72) Inventors: Austin Schmitt, Menomonee Falls, WI (US); Brian Heidemann, Lakes Mills, WI (US); Dean Wardle, Oconomowoc, WI (US); Allen Tewes, Spirit Lake, IA (US); Michael Kujak, Delafield, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 15/969,180

(22) Filed: May 2, 2018

(65) Prior Publication Data

US 2018/0252124 A1 Sep. 6, 2018

Related U.S. Application Data

(63) Continuation of application No. 15/216,352, filed on Jul. 21, 2016, now Pat. No. 10,072,537.

(60) Provisional application No. 62/196,115, filed on Jul. 23, 2015.

(51) Int. Cl.

| | |
|---|---|
| ***F01L 1/34*** | (2006.01) |
| ***F01L 1/344*** | (2006.01) |
| ***F01L 1/047*** | (2006.01) |

(52) U.S. Cl.

CPC ..... *F01L 1/34403* (2013.01); *F01L 1/047* (2013.01); *F01L 1/34409* (2013.01)

(58) Field of Classification Search

CPC .... F01L 1/34403; F01L 1/047; F01L 1/34409

See application file for complete search history.

(56) References Cited

U.S. PATENT DOCUMENTS

| | | | | |
|---|---|---|---|---|
| 4,986,801 | A | 1/1991 | Ohlendorf et al. | |
| 5,078,647 | A | 1/1992 | Hampton | |
| 5,125,372 | A | 6/1992 | Gondek | |
| 5,163,872 | A | 11/1992 | Niemiec et al. | |
| 5,234,088 | A * | 8/1993 | Hampton | F01L 1/34409 123/90.15 |
| 5,235,941 | A | 8/1993 | Hampton | |
| 5,272,937 | A | 12/1993 | Brosowske et al. | |

(Continued)

FOREIGN PATENT DOCUMENTS

| | | |
|---|---|---|
| DE | 3231503 A1 | 3/1984 |
| DE | 3320835 A1 | 12/1984 |

(Continued)

OTHER PUBLICATIONS

European Patent Office, Extended European Search Report, Application No. 16180764.9, dated Nov. 21, 2016.

*Primary Examiner* — Zelalem Eshete
(74) *Attorney, Agent, or Firm* — Quarles & Brady LLP

(57) ABSTRACT

Systems and methods for varying a rotational relationship between a cam shaft and a crank shaft on an internal combustion engine (i.e., cam phasing) are provided. In particular, systems and methods are provided that facilitates a rotary position of a first component to be accurately controlled with a mechanism causing a second component, which can be coupled to the cam shaft or crank shaft, to follow the rotary position of the first component.

20 Claims, 28 Drawing Sheets

(56) References Cited

U.S. PATENT DOCUMENTS

| | | | |
|---|---|---|---|
| 5,305,717 | A | 4/1994 | Wichelhaus |
| 5,305,719 | A | 4/1994 | Clarke et al. |
| 5,337,711 | A | 8/1994 | Hampton |
| 5,588,404 | A | 12/1996 | Lichti et al. |
| 5,803,030 | A | 9/1998 | Cole |
| 5,934,263 | A | 8/1999 | Russ et al. |
| 5,947,070 | A | 9/1999 | Immel et al. |
| 6,192,842 | B1 | 2/2001 | Haag |
| 6,213,071 | B1 | 4/2001 | Lancefield et al. |
| 6,250,267 | B1 | 6/2001 | Methley |
| 6,253,720 | B1 | 7/2001 | Lancefield et al. |
| 6,328,008 | B1 | 12/2001 | Io |
| 6,363,896 | B1 | 4/2002 | Speier |
| 6,390,045 | B1 | 5/2002 | Mae et al. |
| 6,422,188 | B2 | 7/2002 | Pierik |
| 6,932,036 | B2 | 8/2005 | Aino et al. |
| 7,086,359 | B2 | 8/2006 | Hayase et al. |
| 7,201,122 | B2 | 4/2007 | Schmidt |
| 7,481,191 | B2 | 1/2009 | Watanabe et al. |
| 7,581,316 | B2 | 9/2009 | Grunow |
| 7,614,370 | B2 | 11/2009 | Fischer et al. |
| 7,721,692 | B2 | 5/2010 | Fischer |
| 8,025,035 | B2 | 9/2011 | Berger |
| 8,042,504 | B2 | 10/2011 | Berger |
| 9,228,456 | B2 | 1/2016 | Gross et al. |
| 9,708,942 | B2 | 7/2017 | Zurface et al. |
| 2003/0159670 | A1 | 8/2003 | Simpson et al. |
| 2017/0175595 | A1 | 6/2017 | Berndt |

FOREIGN PATENT DOCUMENTS

| | | | |
|---|---|---|---|
| DE | 19846354 | A1 | 4/2000 |
| DE | 19955507 | A1 | 6/2001 |
| DE | 10352362 | A1 | 6/2005 |
| DE | 102009012137 | A1 | 9/2010 |
| DE | 102010027351 | A1 | 1/2012 |
| EP | 0558198 | A1 | 9/1993 |
| EP | 0558199 | A1 | 9/1993 |
| EP | 0558200 | A1 | 9/1993 |
| EP | 1598527 | A2 | 11/2005 |
| EP | 1801367 | A1 | 6/2007 |
| JP | H0153105 | A | 6/1998 |
| JP | 2007092674 | A | 4/2007 |
| JP | 2010001877 | A | 1/2010 |
| JP | 2010014097 | A | 1/2010 |
| WO | 0123713 | A1 | 4/2001 |
| WO | 2012042408 | A1 | 4/2012 |

* cited by examiner

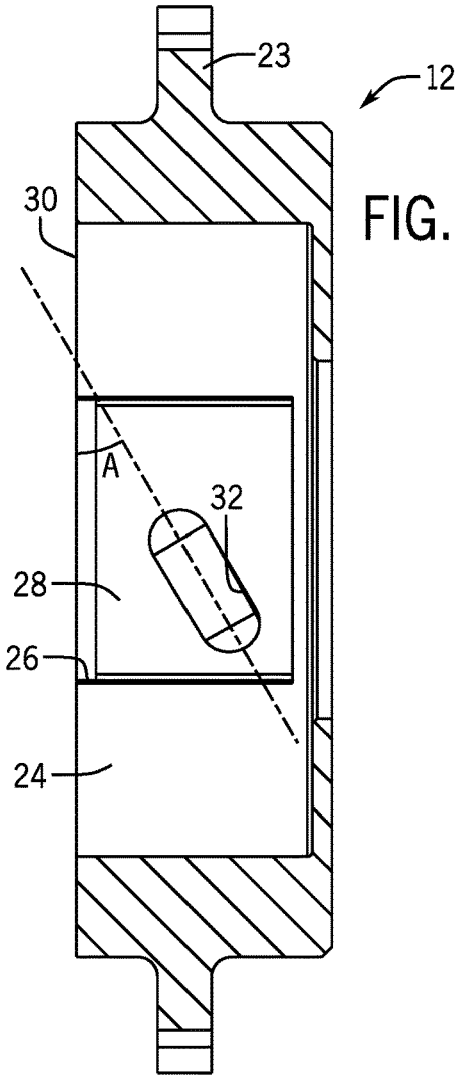
FIG. 4
FIG. 5
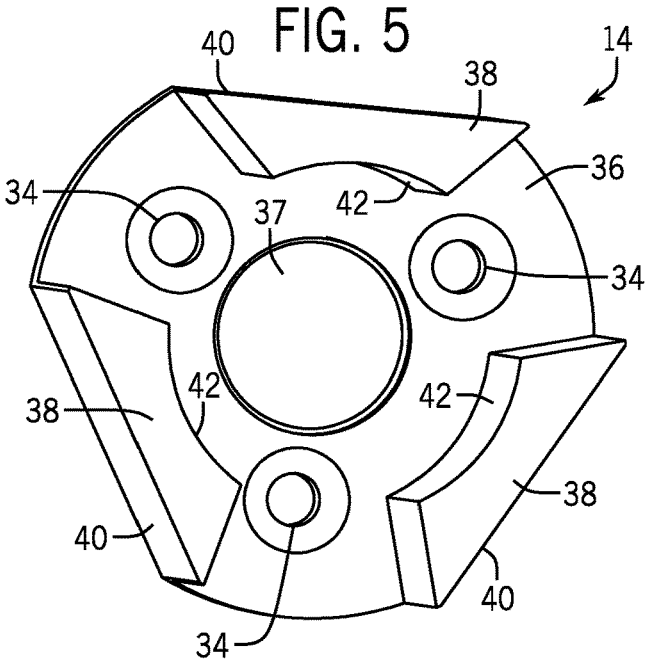

MECHANICAL CAM PHASING SYSTEMS AND METHODS

RELATED APPLICATIONS

The present application is a continuation of U.S. patent application Ser. No. 15/216,352, filed on Jul. 21, 2016, which claims priority to U.S. Provisional Patent Application No. 62/196,115, filed Jul. 23, 2015, and entitled "Mechanical Cam Phasing System and Method." The entire disclosures of which are incorporated herein by reference in their entirety.

BACKGROUND

Cam phasing systems can include a rotary actuator, or phaser, that may be configured to rotate a cam shaft relative to a crank shaft of an internal combustion engine. Currently, phasers can be hydraulically actuated, electronically actuated, or mechanically actuated. Typically, mechanically actuated phasers harvest cam torque pulses to enable the rotation of the phaser. This operation only allows the phaser to rotate in the direction of the cam torque pulse. Additionally, a speed of the rotation of the phaser and a stop position of the phaser after the cam torque pulse has ended, are functions of a magnitude/direction of the cam torque pulses and a speed of the engine, among other things. Thus, the speed of the phaser rotation and stop position cannot be controlled by such mechanical cam phasing systems. Since the cam torque pulses can be large relative to the dampening of the mechanical cam phasing system, the phaser can easily overshoot or undershoot the desired rotation amount, which can result in the mechanical cam phasing system continuously being cycled on and off, or requiring very fast control.

BRIEF SUMMARY OF THE INVENTION

Due to the deficiencies in current mechanical cam phasing systems, it would be desirable to have a cam phasing system capable of altering the relationship between the cam shaft and the crank shaft on an internal combustion engine independently of a magnitude and direction of cam torque pulses and engine speed.

In one aspect, the present invention provides a method for mechanically varying a rotational relationship between a cam shaft and a crank shaft of an internal combustion engine using a cam phasing system. The cam phasing system includes a first component, a second component configured to be coupled to one of the cam shaft and the crank shaft, and a third component configured to be coupled to one of the cam shaft and the crank shaft not coupled to the second component. The method includes providing an input force to the cam phasing system, and rotating the first component to a known rotary position relative to the third component, in response to the provided input force. The method further includes upon the first component rotating to the known rotary position, unlocking a first locking feature configured to enable the second component to rotationally follow the first component to the known rotary position. A second locking feature remains in a locked state to constrain the second component to only rotate in a same direction as the first component. The method further includes upon unlocking the first locking feature, the second component rotationally following the first component to the known rotary position relative to the third component thereby varying a rotational relationship between the cam shaft and the crank shaft of the internal combustion engine.

In some aspects, the method further includes upon the second component reaching the known rotary position, locking the first locking feature.

In some aspects, providing an input force to the cam phasing system includes coupling an actuation mechanism to the first component, and applying an axial force to the first component via the actuation mechanism to axially displace the first component to a known axial position.

In some aspects, providing an axial input force to the cam phasing system includes coupling an actuation mechanism to a fourth component coupled to the first component, and applying an axial force to the fourth component via the actuation mechanism to axially displace the first component to a known axial position.

In some aspects, unlocking a first locking feature includes engaging one or more first roller bearings wedged between the second component and the third component with the first component, and upon the first component engaging the one or more first roller bearings, rotationally displacing the one or more first roller bearings to unwedge the one or more first roller bearings from between the second component and the third component.

In some aspects, unlocking a first locking feature includes engaging one or more first wedged features wedged between the second component and the third component with the first component, and upon the first component engaging the one or more first wedged features, rotationally displacing the one or more first wedged features to unwedge the one or more first wedged features from between the second component and the third component.

In some aspects, the second component rotationally following the first component to the known rotary position includes harvesting cam torque pulses from the cam shaft applied to the second component.

In another aspect, the present invention provides a method for mechanically varying a rotational relationship between a cam shaft and a crank shaft of an internal combustion engine using a cam phasing system. The cam phasing system includes a first component, a second component configured to be coupled to one of the cam shaft and the crank shaft, and a third component configured to be coupled to one of the cam shaft and the crank shaft not coupled to the second component. The method includes providing an input force to the cam phasing system, and displacing the first component to a known axial position relative to the third component, in response to the provided input force. The method further includes upon the first component displacing to the known axial position, unlocking a first locking feature configured to enable the second component to rotationally displace in a desired direction relative to the third component. A second locking feature remains in a locked state to constrain the second component to only rotate in the desired direction relative to the third component. The method further includes upon unlocking the first locking feature, the second component rotating to a known rotary position relative to the third component thereby varying a rotational relationship between the cam shaft and the crank shaft of the internal combustion engine.

In some aspects, the method further includes upon the second component reaching the known rotary position, locking the first locking feature.

In some aspects, providing an input force to the cam phasing system includes coupling an actuation mechanism to the first component, and applying an axial force to the first component via the actuation mechanism to axially displace the first component to a known axial position.

In some aspects, unlocking a first locking feature includes engaging one or more first wedged features wedged between the second component and the third component with the first component, and upon the first component engaging the one or more first wedged features, axially displacing the one or more first wedged features to unwedge the one or more first wedged features from between the second component and the third component.

In some aspects, the second component rotationally following the first component to the known rotary position includes harvesting cam torque pulses from the cam shaft applied to the second component.

In still another aspect, the present invention provides a cam phasing system configured to vary a rotational relationship between a cam shaft and a crank shaft of an internal combustion engine. The cam phasing system coupled to an actuation mechanism. The cam phasing system includes a first component configured to rotate in a desired direction to a known rotary position, in response to an input displacement applied by the actuation mechanism. The cam phasing system further includes a second component configured to be coupled to one of the cam shaft and the crank shaft, a third component configured to be coupled to one of the cam shaft and the crank shaft not coupled to the second component, and a plurality of locking mechanism each having a first locking feature and a second locking feature. Each of the first locking features and the second locking features are moveable between a locked position and an unlocked position. The first locking features are configured to move to the unlocked position and the second locking features are configured to remain in a locked position in response to rotation of the first component to the known rotary position. When the first locking features move to the unlocked position, the second component is configured to rotate relative to the third component and rotationally follow the first component to the known rotary position.

In some aspects, when the second component rotationally follows the first component to the known rotary position, the second locking features remain in the locked position and inhibit rotation of the second component in a direction opposite to the desired direction.

In some aspects, the actuation mechanism is coupled to the first component and configured to apply the input displacement directly to the first component.

In some aspects, the first component includes a plurality of protrusions received within a corresponding one of a plurality of helical features arranged on the third component.

In some aspects, when the input displacement is applied to the first component, the plurality of protrusions displace along the plurality of helical features to enable rotation of the first component in the desired direction to the known rotary position.

In some aspects, the first component includes a plurality of arms arranged circumferentially around the first component, and a corresponding one of the plurality of locking mechanisms are arranged between adjacent pairs of the plurality of arms.

In some aspects, when the first component is rotated to the known rotary position, the plurality of arms engage the first locking features to rotationally displace the first locking features into the unlocked position.

In some aspects, the plurality of locking mechanisms each include a biasing member to force the first locking feature and the second locking feature away from one another.

In some aspects, the first locking features and the second locking features comprise roller bearings.

In some aspects, the first locking features and the second locking features comprise wedged features.

In some aspects, the cam phasing system further includes a helix rod coupled to the first component.

In some aspects, the actuation mechanism is coupled to the helix rod and configured to apply the input displacement directly to the helix rod.

In some aspects, the helix rod includes a plurality of splines defining a helical portion configured to be received within and interact with a plurality of helical features in the first component, and the interaction between the helical portion of the plurality of splines and the plurality of helical features enable the rotation of the first component in the desired direction in response to the input displacement.

In some aspects, the cam phasing system further includes an end plate fixed to the third component and coupled to the helix rod, the coupling of the helix rod and the end plate locks a rotational position of the helix rod relative to the end plate.

In some aspects, the cam phasing system further includes a second component sleeve received around a central hub of the second component.

In some aspects, the cam phasing system further includes a third component sleeve received within the third component and in engagement with an inner surface thereof.

In some aspects, the cam phasing system further includes a return spring configured to return the second component to an original rotary position when the input displacement is removed.

BRIEF DESCRIPTION OF DRAWINGS

FIG. 4 is a cross-section view of a sprocket hub of the cam phasing system of FIG. 2 taken across line 4-4.

FIG. 5 is a top, front, left isometric view of a cradle rotor of the cam phasing system of FIG. 1.

DETAILED DESCRIPTION OF THE INVENTION

Figure 1:
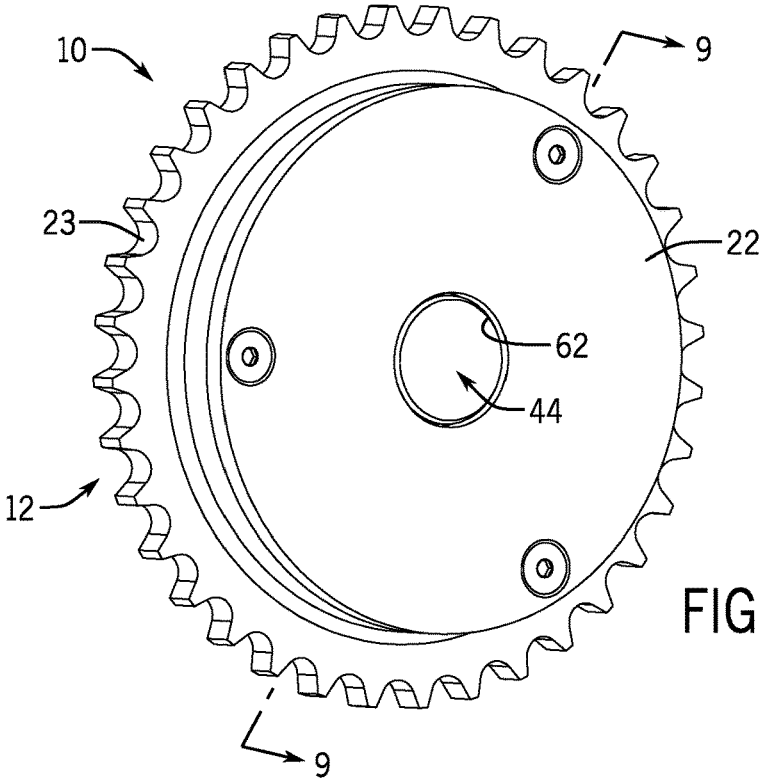
FIG. 1 is a bottom, front, left isometric view of a cam phasing system according to one embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

The systems and methods described herein are capable of altering a rotational relationship between a cam shaft and a crank shaft on an internal combustion engine (i.e., cam phasing) independent of engine speed and a magnitude of cam torque pulses. As will be described, the systems and methods provide an approach that facilitates a rotary position of a first component to be accurately controlled with a mechanism causing a second component, which can be coupled to the cam shaft or crank shaft, to follow the rotary position of the first component.

Figure 3:
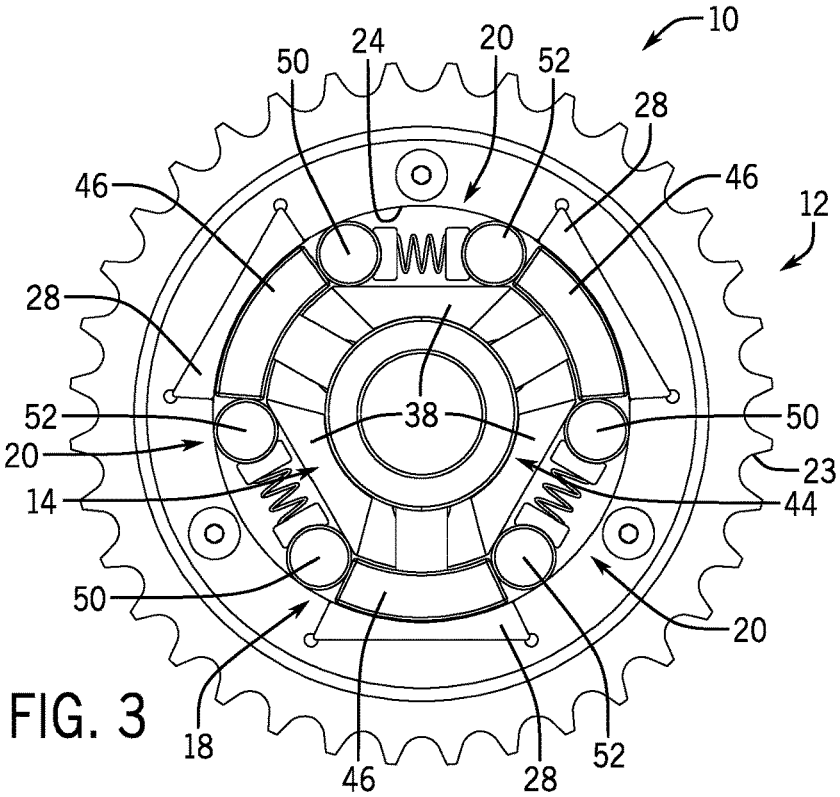
FIG. 3 is a front view of the cam phasing system of FIG. 1 with a cover of the cam phasing system transparent.
Figure 2:
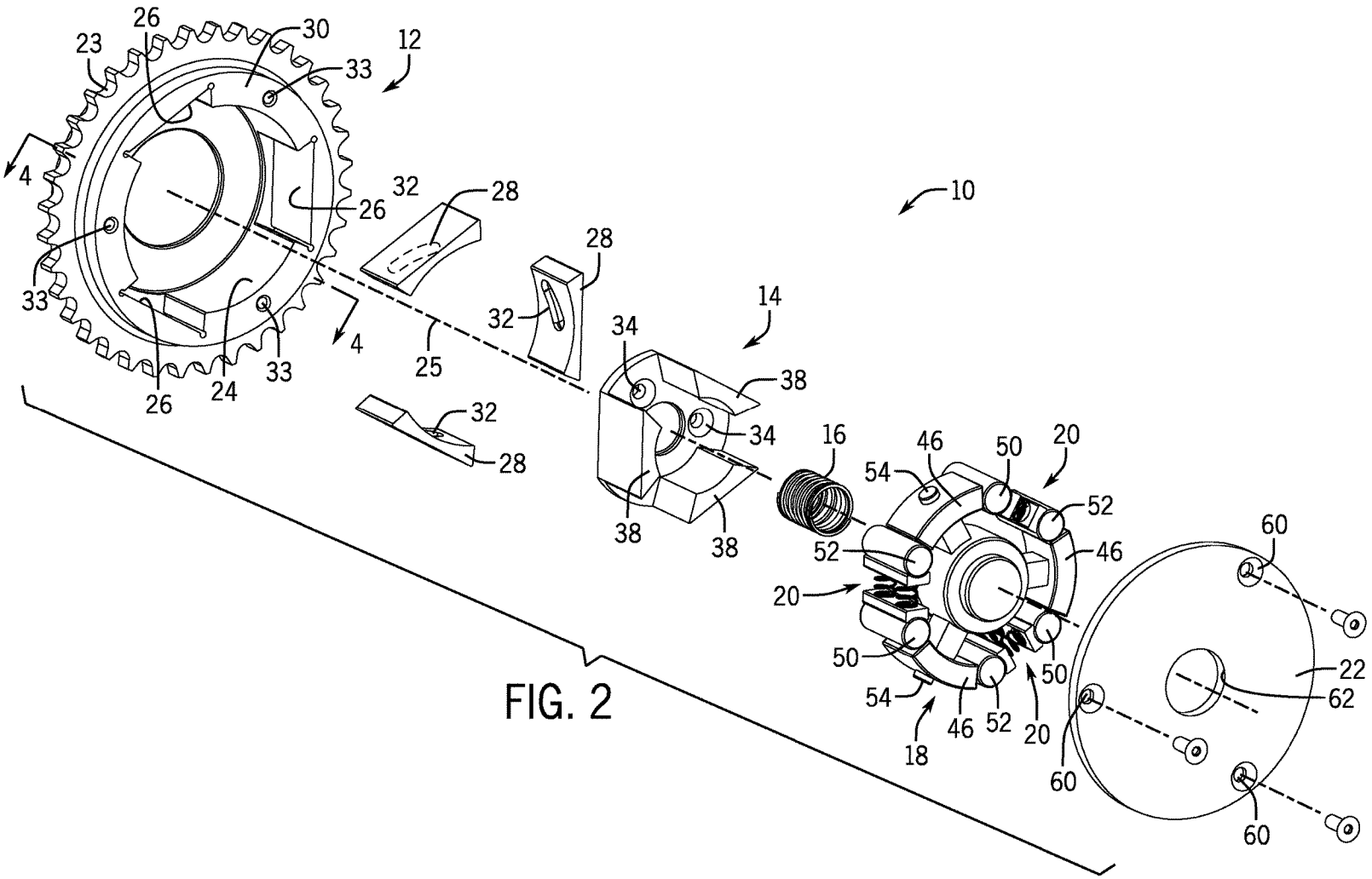
FIG. 2 is an exploded top, front, left isometric view of the cam phasing system of FIG. 1.

FIG. 1 shows a cam phasing system 10 configured to be coupled to a cam shaft (not shown) of an internal combustion engine (not shown) according to one embodiment of the present invention. As shown in FIGS. 1-3, the cam phasing system 10 can include a sprocket hub 12, a cradle rotor 14, a load spring 16, a spider rotor 18, a plurality of locking assemblies 20, and a cover 22. The sprocket hub 12, the cradle rotor 14, the spider rotor 18 and the cover 22 can each share a common central axis 25, when assembled. The sprocket hub 12 can include a gear 23 arranged on an outer diameter thereof, which can be coupled to the crank shaft (not shown) of the internal combustion engine (not shown), for example, via a belt, chain, or gear train assembly. This can drive the sprocket hub 12 to rotate at a speed proportional to the speed of the crank shaft.

The sprocket hub 12 can include an inner surface 24, and a front surface 30. The inner surface 24 can define a plurality of cutouts 26 each configured to receive a corresponding hub insert 28. The illustrated inner surface 24 of the sprocket hub 12 can include three cutouts 26 arranged circumferentially around the inner surface 24 at about 120 degree increments. In other embodiments, the inner surface 24 of the sprocket hub 12 may include more or less than three cutouts 26 and/or the cutouts 26 may be arranged circumferentially around the inner surface 24 at any increment, as desired. The front surface 30 of the sprocket hub 12 can include a plurality of apertures 33 configured to receive a fastening element for attaching the cover 22 to the sprocket hub 12.

The cover 22 can include a plurality of cover apertures 60 and a central aperture 62. Each of the plurality of cover apertures 60 can be arranged to align with a corresponding aperture 33 on the front surface 30 of the sprocket hub 12. The central aperture 62 can be configured to enable access to the spider rotor 18, as will be described below.

As will be described, the design of the cam phasing system 10 is configured to enable the spider rotor 18 to rotate relative to the sprocket hub 12. In another embodiment, the cam phasing system 10 may be configured to enable the spider rotor 18 to rotate relative to the cradle rotor 14. For example, the plurality of cutouts 26, which are each configured to receive a corresponding hub insert 28, may be arranged on the cradle rotor 14 to enable rotation of the spider rotor 18 with respect to the cradle rotor 14.

The hub inserts 28 can each include a helical feature 32. In the illustrated non-limiting example, the helical features 32 can be in the form of a recessed slot formed in the hub inserts 28 at an angle. That is, as shown in FIG. 4, the helical features 32 can each define an angle A formed between a centerline of the respective helical feature 32 and a plane defined by the front surface 30. In some embodiments, the angle A can be between approximately 0 degrees and approximately 90 degrees. It should be appreciated that a magnitude of the angle A can control a magnitude of rotation of the spider rotor 18 in response to an axial displacement. That is, the angle A can control how many degrees the spider rotor 18 rotates relative to the sprocket hub 12 for a given axial input displacement. Thus, the angle A may be varied depending on the application and this desired magnitude of rotation of spider rotor 18 relative to the cradle rotor 12.

Turning to FIG. 5, the cradle rotor 14 can be configured to be fastened to the cam shaft (not shown) of the internal combustion engine via one or more cam coupling apertures 34. The cam coupling apertures 34 can be arranged on a front surface 36 of the cradle rotor 14. The illustrated cradle rotor 14 can include three coupling apertures 34 but, in other embodiments, the cradle rotor 14 may include more or less than three coupling apertures 34. In another embodiment, the cam coupling apertures 34 may be arranged on the sprocket hub 12. It would be known by one of ordinary skill in the art that alternative configurations for the relative coupling of the sprocket hub 12, the cradle rotor 14, the cam shaft, and the crank shaft are possible. For example, in one embodiment, the gear 23 may be coupled to the cradle rotor 14 and the cam shaft may be coupled to the sprocket hub 12. The cradle rotor 14 can include a central recess 37 centrally arranged on the front surface 36. The central recess 39 can be configured to receive the load spring 16, when the cam phasing system 10 is assembled.

A plurality of angled wedging members 38 can extend substantially perpendicularly from a periphery of the front surface 36 of the cradle rotor 14. The angled wedging members 38 can each include a substantially flat surface 40 each configured to engage a corresponding one of the locking assemblies 20, and an inner surface 42 that can define a curved shape and can be configured to engage a central hub 44 of the spider rotor 18. The illustrated cradle rotor 14 can include three angled wedging members 38 arranged circumferentially at about 120 degree increments around the periphery of the front surface 36. In other embodiments, the cradle rotor 14 may include more or less than three angled wedging members 38 and/or the angled wedging members 38 may be arranged circumferentially around the periphery of the front surface 36 at any increment, as desired. When the cam phasing system 10 is assembled, as shown in FIG. 3, the cradle rotor 14 can be configured to rotate relative to the sprocket hub 12 in response to an axial displacement applied to the spider rotor 18, as will be described in detail below.

Figure 6:
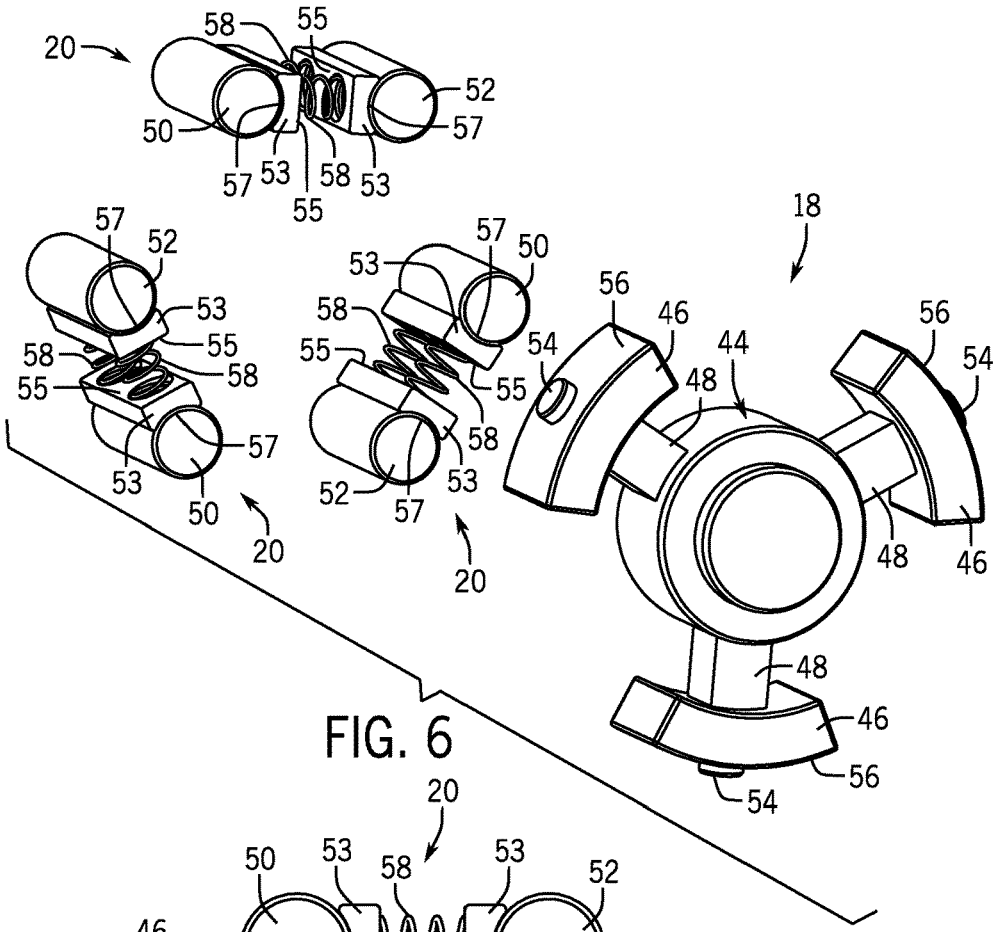
FIG. 6 is a exploded top, front, left isometric view of a spider rotor and a plurality of locking assemblies of the cam phasing system of FIG. 1.
Figure 7:
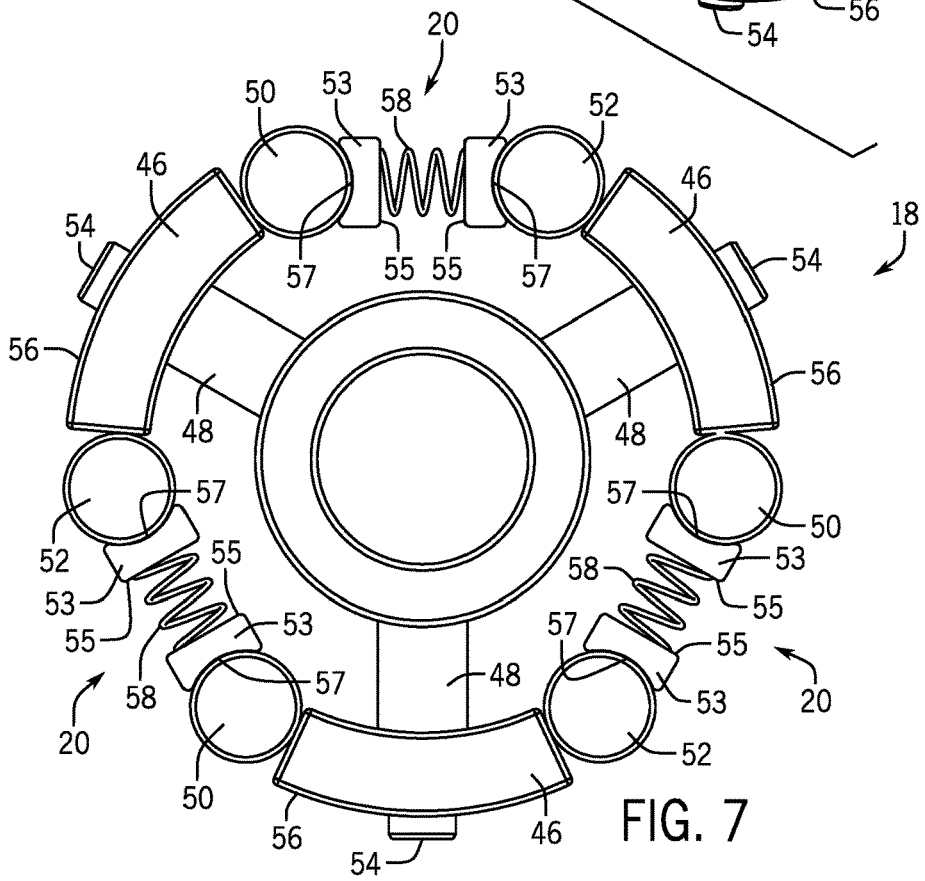
FIG. 7 is a front view of a spider rotor and a plurality of locking assemblies of the cam phasing system of FIG. 1 with plurality of locking assemblies assembled.

As shown in FIGS. 6 and 7, the spider rotor 18 can include the central hub 44 and a plurality of lock engaging members 46 arranged circumferentially around the central hub 44. Each lock engaging member 46 can extend from the central hub 44 by an extending member 48. As shown in FIGS. 2 and 3, the lock engaging members 46 can be spaced circumferentially around the central hub 44 such that a gap can exist between adjacent lock engaging members 46. Each gap can be dimensioned such that a corresponding one of the locking assemblies 20 can be arranged therein, as shown in FIGS. 3 and 7.

Each lock engaging member 46 can define a substantially curved shape to conform generally to a shape defined by the inner surface 24 of the sprocket hub 12. Each lock engaging member 46 can include a protrusion 54 protruding from an outer surface 56 of the bearing engaging member 46. When the cam phasing system 10 is assembled, each protrusion 54 can be received within a corresponding helical feature 32 of a corresponding one of the hub inserts 28. The helical features 32 and the protrusions 54 can cooperate to enable rotation of the spider rotor 18 relative to the sprocket hub 12 in response to an axial displacement. It should be known that other configurations may be possible that enable the spider rotor 18 to rotate relative to the sprocket hub 12. For example, in one embodiment, a ball bearing may be received within the helical features 32.

The spider rotor 18 can include three lock engaging members 46 extending from the central hub 44 that can be arranged circumferentially at about 120 degree increments around central hub 44 of the spider rotor 18. In other embodiments, the spider rotor 18 may include more or less than three lock engaging members 46 and/or the lock engaging members 46 may be arranged circumferentially at any increment around the central hub 44, as desired.

Each locking assembly 20 can include a first locking feature 50, a second locking feature 52, and corresponding locking feature supports 53 in engagement with a corresponding one of the first and second locking features 50 and 52. The first locking feature 50 and the second locking feature 52 can be forced away from each other by one or more biasing members 58. The biasing members 58 can be arranged between and in engagement with corresponding pairs of the locking feature supports 53 thereby forcing the first and second locking features 50 and 52 away from each other. Each illustrated locking assembly 20 can include two biasing members 58 in the form of springs. In other embodiments, the locking assemblies 20 each may include more or less than two biasing members 58, and/or the biasing members 58 may be in the form of any viable mechanical linkage capable of forcing the first locking feature 50 and the second locking feature 52 away from each other, as desired.

Figure 8:
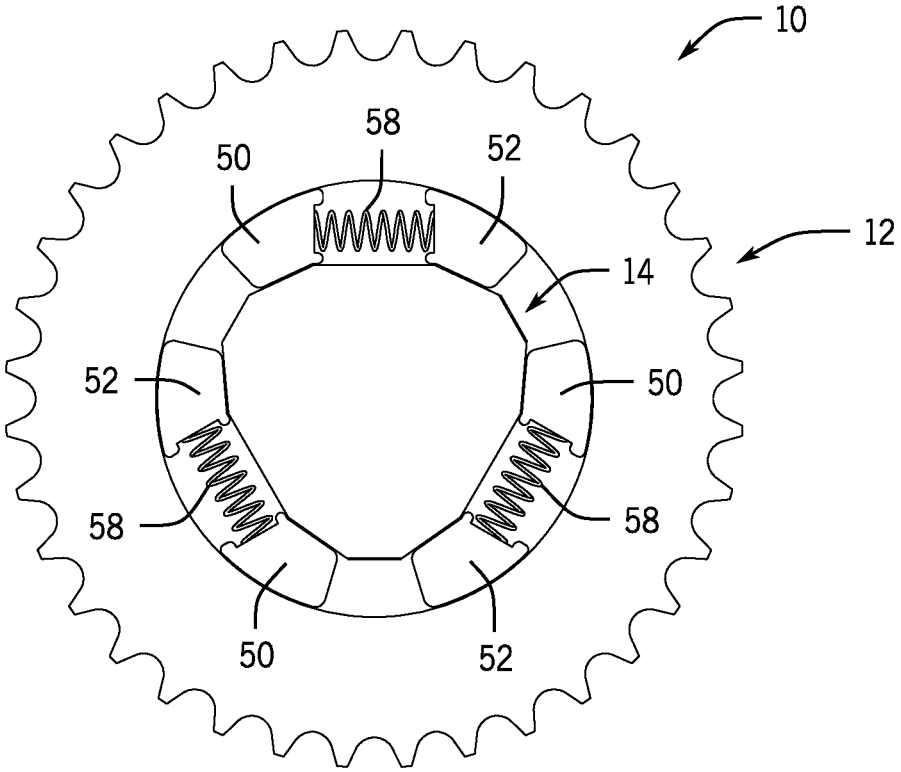
FIG. 8 is a front view of the cam phasing system of FIG. 1 with first and second locking features in the form of wedged features.

The locking features supports 53 each can include a generally flat surface 55 in engagement with the biasing members 58 and a generally conforming surface 57. The illustrated first and second locking features 50 and 52 can be in the form of round roller bearings. Thus, the generally conforming surfaces 57 of the locking feature supports 53 each can define a generally round, or semi-circular, shape. It should be appreciated that the first and second locking features 50 and 52 may define any shape that enables locking the cradle rotor 14. It should also be appreciated that alternative mechanisms are possible for the first and second locking features 50 and 52 other than a bearing. For example, as shown in FIG. 8, the first and second locking features 50 and 52 may be in the form of wedged features.

Figure 9:
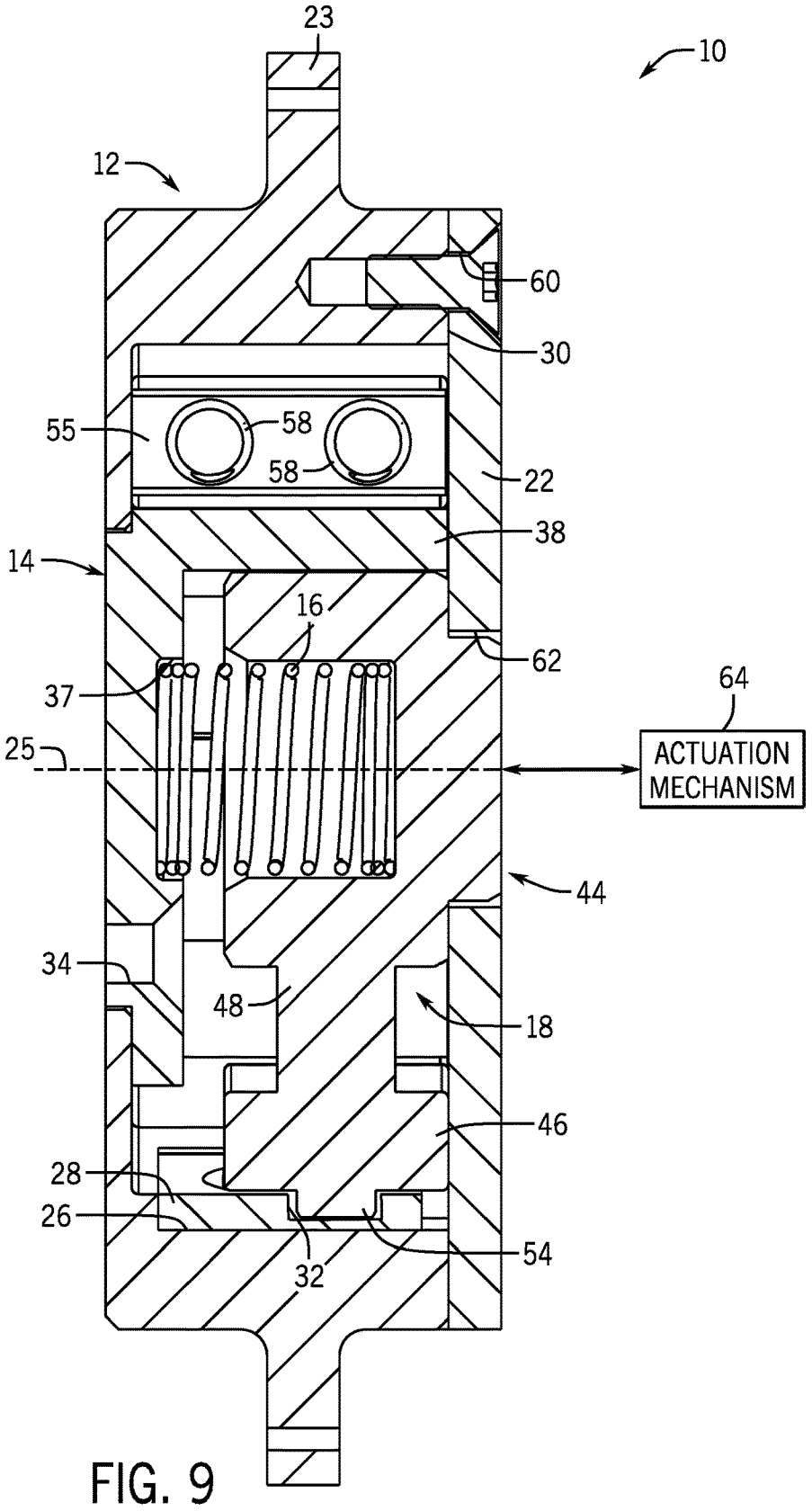
FIG. 9 is a cross-sectional view of the cam phasing system of FIG. 1 taken along line 9-9.

As shown in FIG. 9, an actuation mechanism 64 can be configured to engage the central hub 44 of the spider rotor 18 through the central aperture 62 of the cover 22. The actuation mechanism 64 can be configured to apply a force to the central hub 44 of the spider rotor 18 in a direction substantially perpendicular to a plane defined by the front surface 30 of the sprocket hub 12. That is, the actuation mechanism 64 can be configured to apply an axial force to the central hub 44 of the spider rotor 18 in a direction parallel to, or along, the central axis 25. The actuation mechanism 64 may be a linear actuator, a mechanical linkage, a hydraulically actuated actuation element, or any viable mechanism capable of providing an axial force and/or displacement to the central hub 44 of the spider rotor 18. In operation, as described below, the actuation mechanism 64 can be configured to apply the axial force to the spider rotor 18 to achieve a known axial displacement of the spider rotor 18, which corresponds with a known desired rotational displacement of the spider rotor 18. In other embodiments, the actuation mechanism 64 may be configured to provide a rotary torque to the spider rotor 18 using a solenoid, hydraulic pressure, or a rotary solenoid. The actuation mechanism 64 can be controlled and powered by the engine control module (ECM) of the internal combustion engine.

The load spring 16 can be arranged between the cradle rotor 14 and the spider rotor 18 between the central recess 37 of the cradle rotor 14 and a central cavity 65 in the central hub 44 of the spider rotor 18. The load spring 16 can be configured to return the spider rotor 18 to a starting position once a force or displacement applied by the actuation mechanism 64 is removed. In some embodiments, the load spring 16 can be in the form of a linear spring. In other embodiments, the load spring 16 can be in the form of a rotary spring. It should be appreciated that, in some embodiments, the load spring 16 may not be included in the cam phasing system 10, if the actuation mechanism 64 is configured to push and pull the central hub 44 of the spider rotor 18 axially along the central axis 25.

Operation of the cam phasing system 10 will be described with reference to FIGS. 1-10D. It should be appreciated that the locking feature supports 53 and the biasing members 58 are transparent in FIGS. 10A-10D for ease of illustration. As described above, the sprocket hub 12 can be coupled to the crank shaft of the internal combustion engine. The cam shaft of the internal combustion engine can be fastened to the cradle rotor 14. Thus, the cam shaft and the crank shaft can be coupled to rotate together via the cam phasing system 10. The cam shaft can be configured to actuate one or more intake valves and/or one or more exhaust valves during engine operation. During engine operation, the cam phasing system 10 can be used to alter the rotational relationship of the cam shaft relative to the crank shaft, which, in turn, alters when the intake and/or exhaust valves open and close. Altering the rotational relationship between the cam shaft and the crank shaft can be used to reduce engine emissions and/or increase engine efficiency at a given operation condition.

Figure 10A:
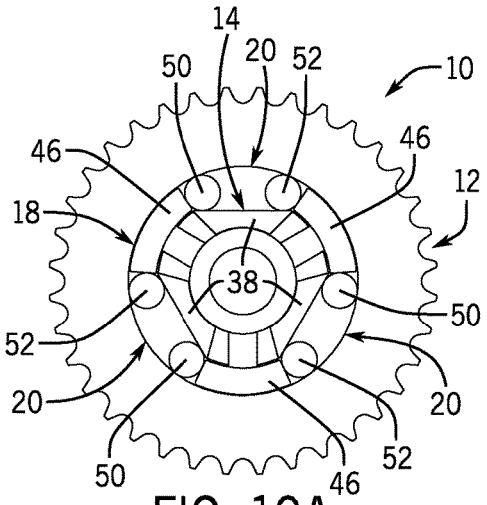
FIG. 10A is a front view of the cam phasing system of FIG. 1 with a cover of the cam phasing system transparent and the cam phasing system in a locked state.

When the engine is operating and no rotational adjustment of the cam shaft is desired, the cam phasing system 10 can lock the rotational relationship between the sprocket hub 12 and the cradle rotor 14, thereby locking the rotational relationship between the cam shaft and the crank shaft. In this locked state, as shown in FIG. 10A, the first locking feature 50 and the second locking feature 52 can be fully extended away from each other, via the biasing members 58, such each pair of the first and second locking features 50 and 52 are wedged between a corresponding one of the plurality of angled wedging members 38 and the inner surface 24 of the sprocket hub 12. This wedging can lock, or restrict movement of, the angled wedging members 38 of the cradle rotor 14 relative to the sprocket hub 12 (i.e., the rotary position of the cradle rotor 14 is locked with respect to the sprocket hub 12). Therefore, the rotational relationship between the cam shaft and the crank shaft is unaltered, when the cam phasing system 10 is in the locked state.

If the cam shaft is desired to advance or retard the intake and/or exhaust valve timing relative to the crank shaft, the actuation mechanism 64 can be instructed by the ECM to provide an axial displacement on the central hub 44 of the spider rotor 18 in the desired direction. The axial displacement provided by the actuation mechanism 64 can cause the protrusions 54 of the lock engaging members 46 to displace along the helical features 32 of the hub inserts 28. Since the helical features 32 can be angled with respect to the front surface 30 of the sprocket hub 12, the displacement of the protrusions 54 along the helical features 32 can cause the spider rotor 18 to rotate clockwise or counterclockwise a known amount, depending on whether it is desired to advance or retard the valve events controlled by the cam shaft.

Figure 10B:
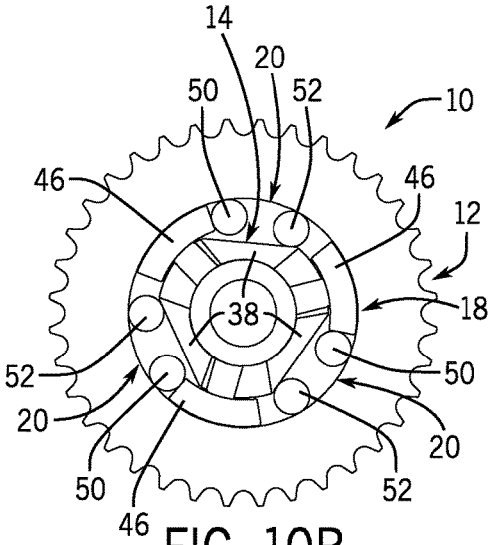
FIG. 10B is a front view of the cam phasing system of FIG. 1 with a cover of the cam phasing system transparent and illustrating an initial clockwise rotation of a cradle rotor in response to a clockwise rotation of a spider rotor.

Once the axial displacement is applied by the actuation mechanism 64, the spider rotor 18 can be rotated a desired amount, based on how far the valve events are desired to advance or retard. When the spider rotor 18 rotates, the lock engaging members 46 of the spider rotor 18 push either one of the first locking features 50 or the second locking features 52 out of the locked, or restricted, position and the other one of the first locking features 50 or the second locking features 52 remain in a locked position. For example, as shown in FIG. 10B, the spider rotor 18 can be rotated clockwise a desired rotational amount from the locked state (FIG. 10A). This rotation of the spider rotor 18 can engage the first locking features 50 and rotationally displace them clockwise into an unlocked position. Meanwhile, the second locking features 52 may not be rotationally displaced and can remain in a locked position.

The unlocking of the first locking features 50 can enable the cradle rotor 14 to rotate in the same rotational direction in which the spider rotor 18 was rotated. Simultaneously, the locked position of the second locking features 52 can prevent rotation of the cradle rotor 14 in a direction opposite to the direction the spider rotor 18 was rotated. Thus, in the non-limiting examples of FIGS. 10A-10D, the unlocked position of the first locking features 50 can enable the cradle rotor 14 to rotate clockwise, while the locked position of the second locking features 52 can prevent the cradle rotor 14 from rotating counterclockwise. This can enable the cam phasing system 10 to harvest energy from cam torque pulses, exerted by the cam shaft when the engine is running, to rotate the cradle rotor 14 such that it follows the spider rotor 18 independent of the magnitude of the cam torque pulses. That is, in the non-limiting examples of FIGS. 10A-10D, due to the locked position of the second locking features 52, cam torque pulses applied to the cradle rotor 14 in the counterclockwise direction will not rotationally displace the cradle rotor 14. Conversely, due to the unlocked position of the first locking features 50, clockwise cam torque pulses that are applied to the cradle rotor 14 will rotate the cradle rotor 14 with respect to the sprocket hub 12 to follow the spider rotor 18.

Figure 10C:
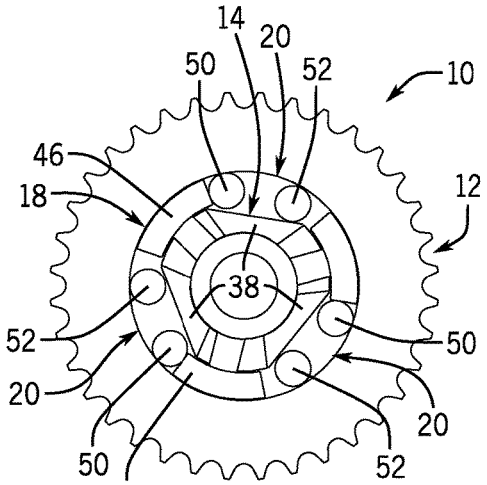
FIG. 10C is a front view of the cam phasing system of FIG. 1 with a cover of the cam phasing system transparent and illustrating further clockwise rotation of a cradle rotor in response to a clockwise rotation of a spider rotor.
Figure 10D:
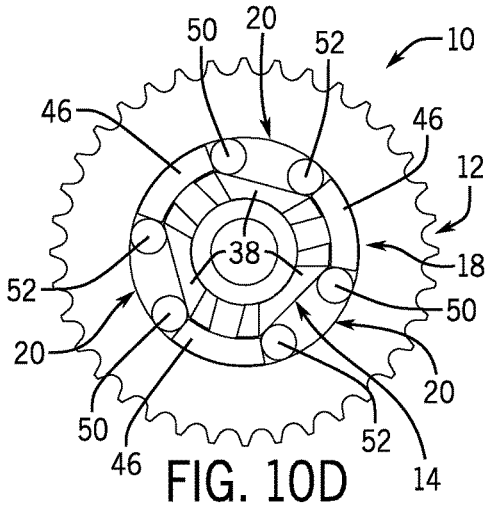
FIG. 10D is a front view of the cam phasing system of FIG. 1 with a cover of the cam phasing system transparent and the cam phasing in a locked state following a clockwise rotation of a cradle rotor in response to a clockwise rotation of a spider rotor.

As cam torque pulses are applied to the cradle rotor 14 in the clockwise direction, the cradle rotor 14 and the second locking features 52 can rotationally displace in a clockwise direction, as shown from FIG. 10B to FIG. 10C. Once the clockwise cam torque pulse diminishes, the cradle rotor 14 can be in a new rotary position (FIG. 10C), where the second locking features 52 again lock the cradle rotor 14 until the next cam torque pulse in the clockwise direction is applied to the cradle rotor 14. This process can continue until, eventually, the cradle rotor 14 will rotationally displace enough such that the first locking features 50 can return to the locked position, as shown in FIG. 10D. When this occurs, the first and second locking features 50 and 52 can both be in the locked position and the cam phasing system 10 can return to a locked state. The spider rotor 18 can then maintain its rotational position (until it is commanded again to alter the rotational relationship of the cam shaft relative to the crank shaft) to ensure that the first locking features 50 and the second locking features 52 remain locked, thereby locking the angular position of the cradle rotor 14 relative to the sprocket hub 12. It should be appreciated that for a counterclockwise rotation of the spider rotor 18, the reverse of the above described process would occur.

The rotation of the cradle rotor 14 with respect to the sprocket hub 12 that occurs during this phasing process, as shown in FIGS. 10A-10D, can vary the rotational relationship between the cam shaft and the sprocket hub 12, which simultaneously alters the rotational relationship between the cam shaft and the crank shaft. As described above, the amount of rotation achieved by the spider rotor 18 for a given axial displacement provided by the actuation mechanism 64 can be known based on the geometry of the helical features 32. Additionally, the speed, or angular velocity at which the spider rotor 18 rotates for a given displacement can also be known. Furthermore, the design of the cam phasing system 10 can enable the cradle rotor 14 to only be allowed to rotate in the same direction as the spider rotor 18. Thus, during engine operation the cam phasing system 10 can alter the rotational relationship between the cam shaft and the crank shaft independent of engine speed, and the direction and magnitude of the cam torque pulses. Also, the cam phasing system 10 does not need to be continually cycled to reach a desired rotational position (i.e., a desired rotational offset between the cam shaft and the crank shaft), as the cradle rotor 14 is constrained to follow the spider rotor 18 to the desired position. Thus, independent of the engine speed and cam torque pulse magnitude, the present invention provides systems and methods for accurately controlling a rotary position of a first component (e.g., the spider rotor 18) with a mechanism causing a second component (e.g., the cradle rotor 14), which can be coupled to the cam shaft or crank shaft, to follow the rotary position of the first component to alter a rotational relationship between a cam shaft and a crank shaft on an internal combustion engine.

Figure 11:
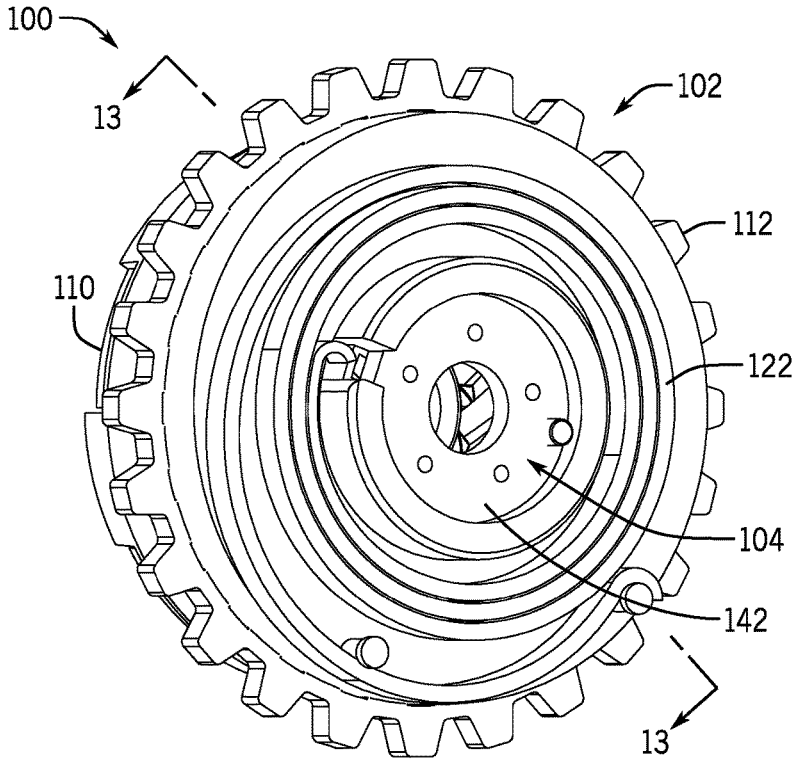
FIG. 11 is a bottom, back, left isometric view of a cam phasing system according to another embodiment of the present invention.
Figure 12:
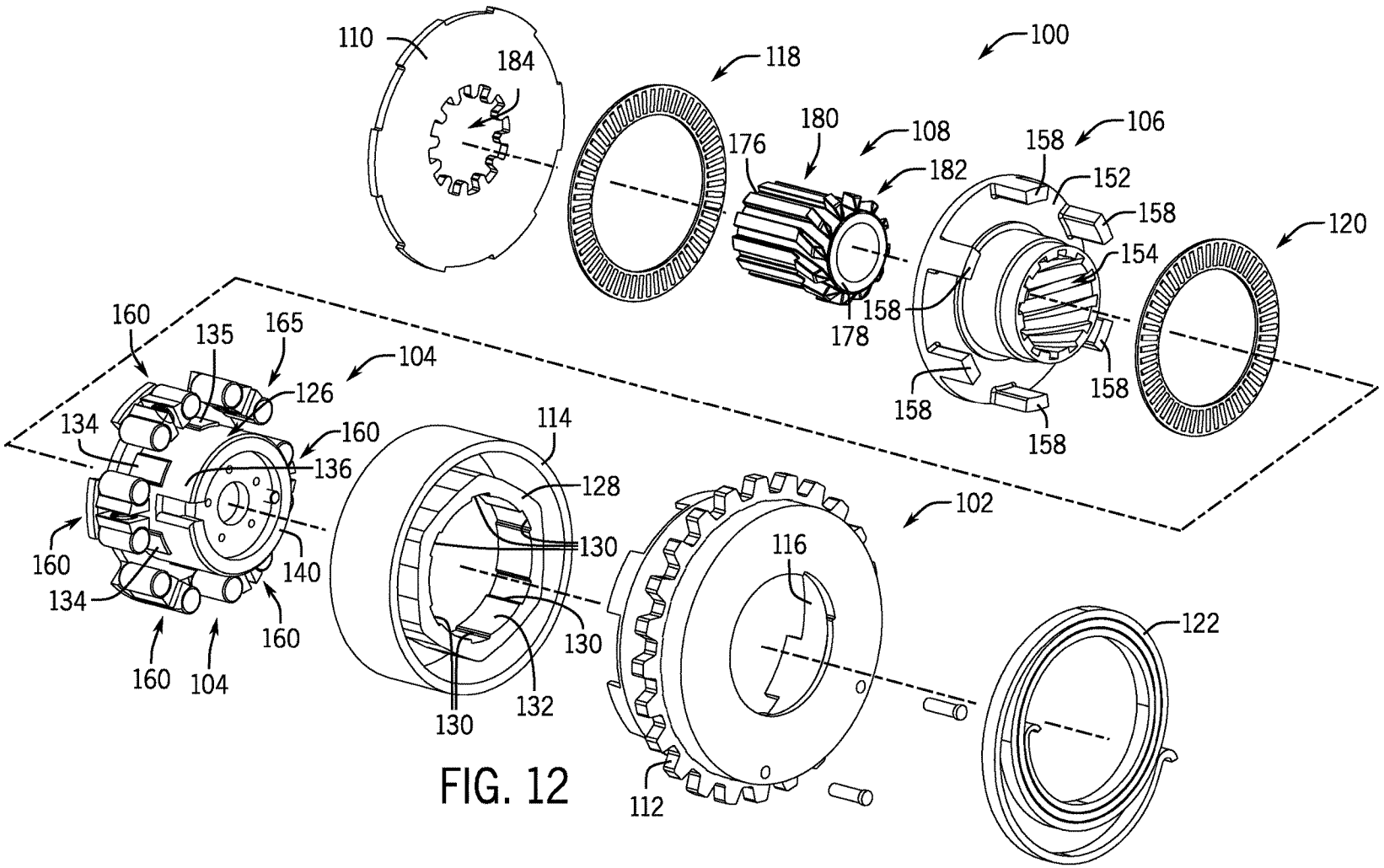
FIG. 12 is an exploded top, back, left isometric view of the cam phasing system of FIG. 11.
Figure 13:
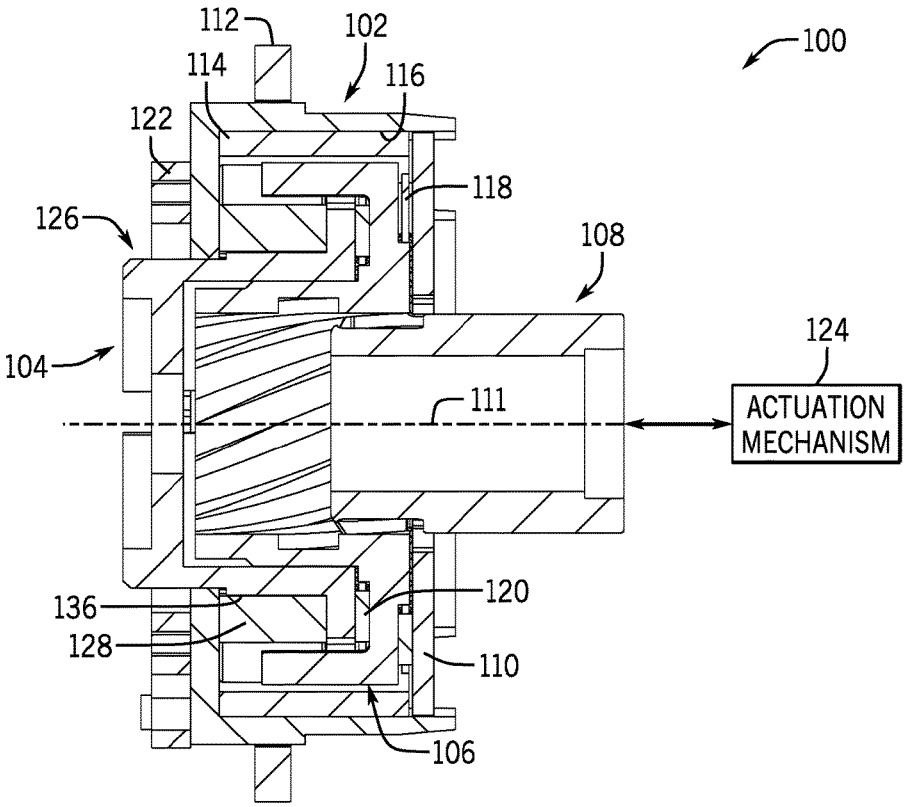
FIG. 13 is a cross-sectional view of the cam phasing system of FIG. 11 taken along line 13-13.

It should be appreciated by one of skill in the art that alternative designs and configurations are possible to provide accurate control of a rotary position of a first component with a mechanism causing a second component, which can be coupled to the cam shaft or crank shaft, to follow the rotary position of the first component. For example, FIGS. 11-15 show a cam phasing system 100 configured to be coupled to a cam shaft (not shown) of an internal combustion engine (not shown) according to another embodiment of the present invention. As shown in FIGS. 11-13, the cam phasing system 100 can include a sprocket hub 102, a cradle rotor 104, a spider rotor 106, a helix rod 108, and an end plate 110. The sprocket hub 102, the cradle rotor 104, the spider rotor 106, the helix rod 108, and the end plate 110 can each share a common central axis 111, when assembled. The sprocket hub 102 can include a gear 112 and a sprocket sleeve 114. The gear 112 can be connected to an outer diameter of the sprocket hub 102 and the gear 112 can be coupled to a crank shaft (not shown) of the internal combustion engine. This can drive the sprocket hub 102 to rotate at the same speed as the crank shaft. The sprocket sleeve 114 defines a generally annular shape and is configured to be received within the sprocket hub 102. When assembled, as shown in FIG. 13, the sprocket sleeve 114 can be dimensioned to be received by and engage an inner surface 116 of the sprocket hub 102. The addition of the sprocket sleeve 114 to the sprocket hub 102 may improve durability and manufacturability of the sprocket hub 102. In particular, the sprocket sleeve 114 can become a simpler geometry and, therefore, can be manufactured to better tolerances with more robust material properties.

With continued reference to FIGS. 11-13, the cam phasing system 10 can include a first bearing ring 118 and a second bearing ring 120 each configured to reduce friction during relative rotation between the spider rotor 106 and the end plate 110 and between the spider rotor 106 and the cradle rotor 104. Each of the first and second ring bearings 118 and 120 define a generally annular shape. When assembled, the first bearing ring 118 is dimensioned to be received between the end plate 110 and the spider rotor 106, and the second bearing ring 120 is dimensioned to be received between the spider rotor 106 and the cradle rotor 104, as shown in FIG. 13.

A balancing spring 122 can be coupled between the sprocket hub 102 and the cradle rotor 104. The illustrated balancing spring 122 is in the form of a rotary spring, but, in other embodiments, the balancing spring 122 may be in the form of another spring device. As described above with reference to the cam phasing system 10, cam torque pulses can be harvested to enable the rotational relationship between the cam shaft and the crank shaft to be varied. In some applications, these cam torque pulses may not be symmetric in magnitude about zero. For example, if the cam torque pulses are modeled as a sine wave, in some applications, the sine wave may not be symmetric in magnitude about zero. The balancing spring 122 can be configured to provide an offset to the harvested cam torque pulses to center the magnitude of the pulses about zero. In other applications, where the magnitudes of the cam torque pulses are symmetric in magnitude about zero, the balancing spring 122 may not be required.

An actuation mechanism 124 can be configured to engage the helix rod 108. The actuation mechanism 124 can be configured to apply an axial force to the helix rod 108 in a direction parallel to, or along, the central axis 111. The actuation mechanism 124 may be a linear actuator, a mechanical linkage, a hydraulically actuated actuation element, or any viable mechanism capable of providing an axial force and/or displacement to the helix rod 108. That is, the actuation mechanism 124 can be configured to axially displace the helix rod 108 to a known position, which corresponding with a desired rotational displacement of the spider rotor 106. The actuation mechanism 124 can be controlled and powered by the engine control module (ECM) of the internal combustion engine.

The cradle rotor 104 can include a central hub 126 and a cradle sleeve 128 configured to be received around the central hub 126. The cradle sleeve 128 can include a plurality of slots 130 arranged on an inner surface 132 thereof. The illustrated cradle sleeve 128 can include six slots 130 arranged circumferentially around the inner surface 132 in approximately 60 degree increments. In other embodiments, the cradle sleeve 128 can include more or less than six slots 130 arranged circumferentially around the inner surface 132 in any increment, as desired. Each of the plurality of slots 130 can define a radial recess that extends axially along the inner surface 132. Each of the plurality of slots 130 can define a substantially rectangular shape dimensioned to receive a corresponding one of a plurality of tabs 134 on the central hub 126. When assembled, as shown in FIG. 13, the cradle sleeve 128 can be configured to be received around an outer surface 136 of the central hub 118 with each of the plurality of tabs 134 arranged within a corresponding one of the plurality of slots 130. The arrangement of the plurality of tabs 134 within the plurality of slots 130 can rotationally interlock the cradle sleeve 128 and the cradle rotor 104. The addition of the cradle sleeve 128 to the cradle rotor 104 may improve durability and manufacturability of the cradle rotor 104. In particular, the cradle sleeve 128 can become a simpler geometry and, therefore, can be manufactured to better tolerances with more robust material properties.

Figure 14:
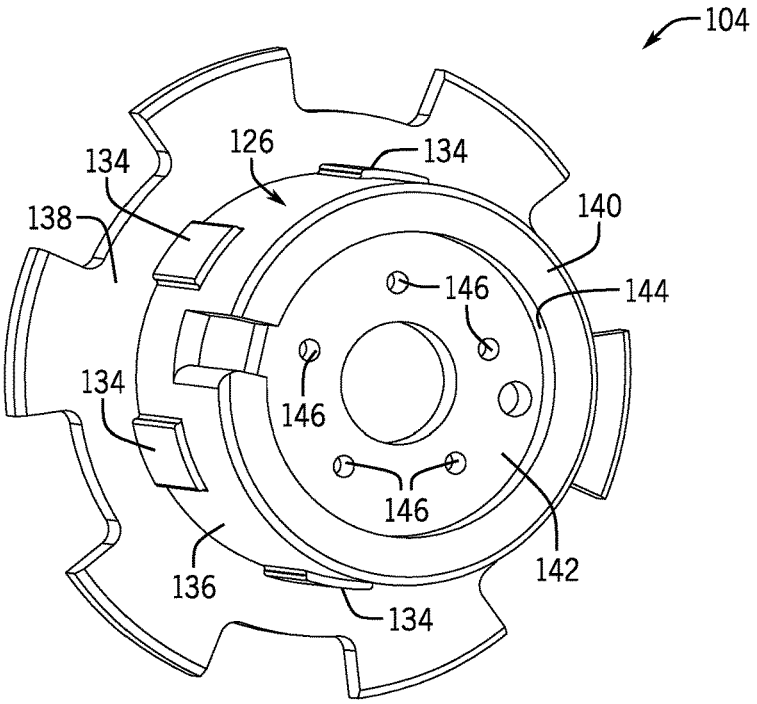
FIG. 14 is a top, back, left isometric view of a cradle rotor of the cam phasing system of FIG. 11.
Figure 15:
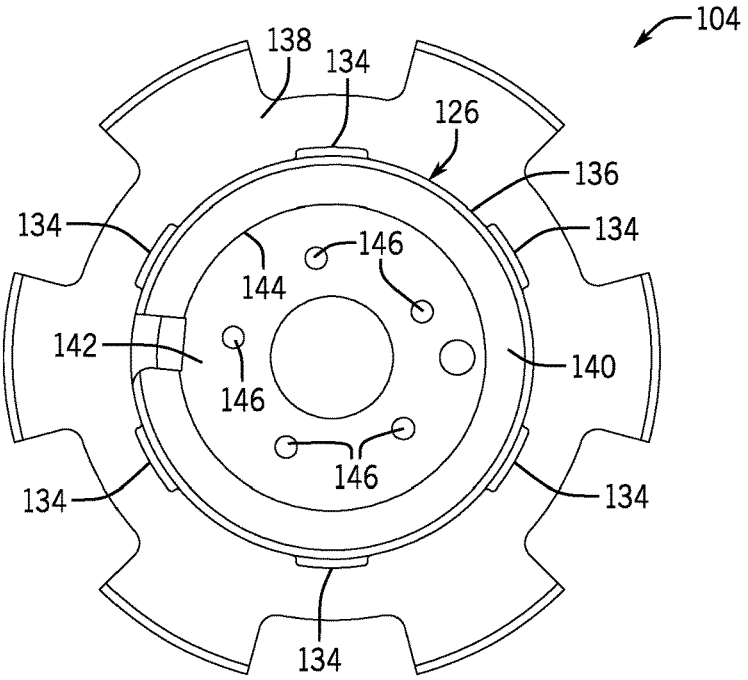
FIG. 15 is a back view of a cradle rotor of the cam phasing system of FIG. 11.

As shown in FIGS. 14 and 15, the central hub 126 can define a generally annular shape and can protrude axially from a front surface 138 of the cradle rotor 104. The plurality of tabs 134 arranged on the outer surface 136 can protrude radially from the outer surface 136 and can be arranged circumferentially around the outer surface 136. The illustrated central hub 126 includes six tabs 134 arranged circumferentially in approximately 60 degree increments around the outer surface 136. In other embodiments, the central hub 126 can include more or less than six tabs 134 arranged circumferentially around the outer surface 136 in any increment, as desired. However, it should be noted that the number and arrangement of the plurality of tabs 134 should correspond with the number and arrangement of the plurality of slots 130 on the cradle sleeve 128.

Each of the plurality of tabs 134 can extend axially along the outer surface 124 from the front surface 138 to a location between the front surface 138 and an end 140 of the central hub 126. Each of the plurality of tabs 134 can define a substantially rectangular shape. In other embodiments, the plurality of tabs 134 can define another shape, as desired. A mounting plate 142 can be arranged within an inner bore 144 defined by the central hub 126. The mounting plate 142 can include a plurality of mounting apertures 146 configured to enable the cam shaft to be fastened to the cradle rotor 104.

The central hub 126 can include a spring slot 148 that defines a generally rectangular cutout in the central hub 126. The spring slot 148 can extend axially along the central hub 126 from the end 140 of the central hub 126 to a location between the end 140 and the front surface 138. The spring slot 148 can provide an engagement point for the balancing spring 122, as shown in FIG. 11.

Figure 16:
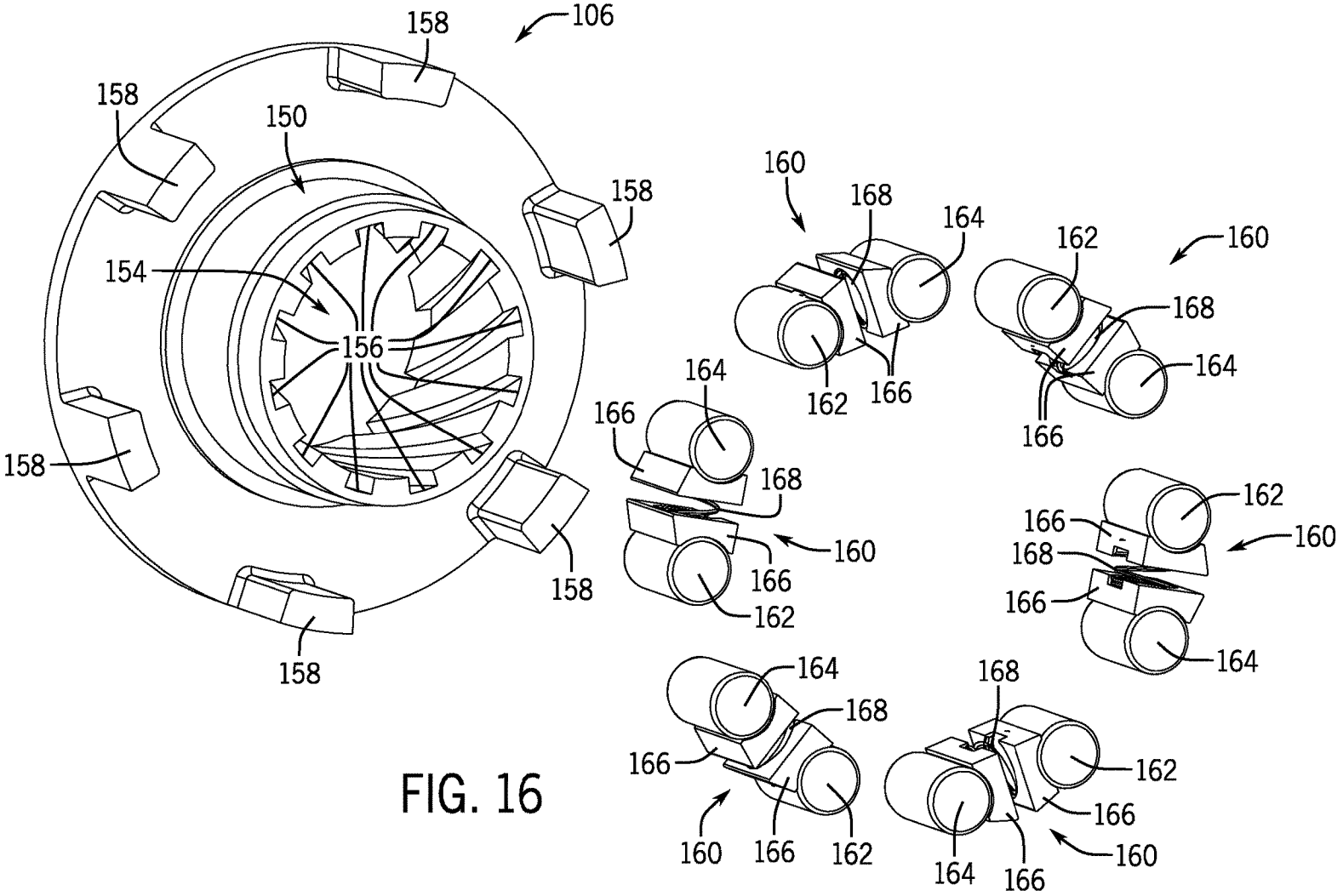
FIG. 16 is an exploded top, back, left isometric view of a spider rotor and a plurality of locking assemblies of the cam phasing system of FIG. 11.
Figure 17:
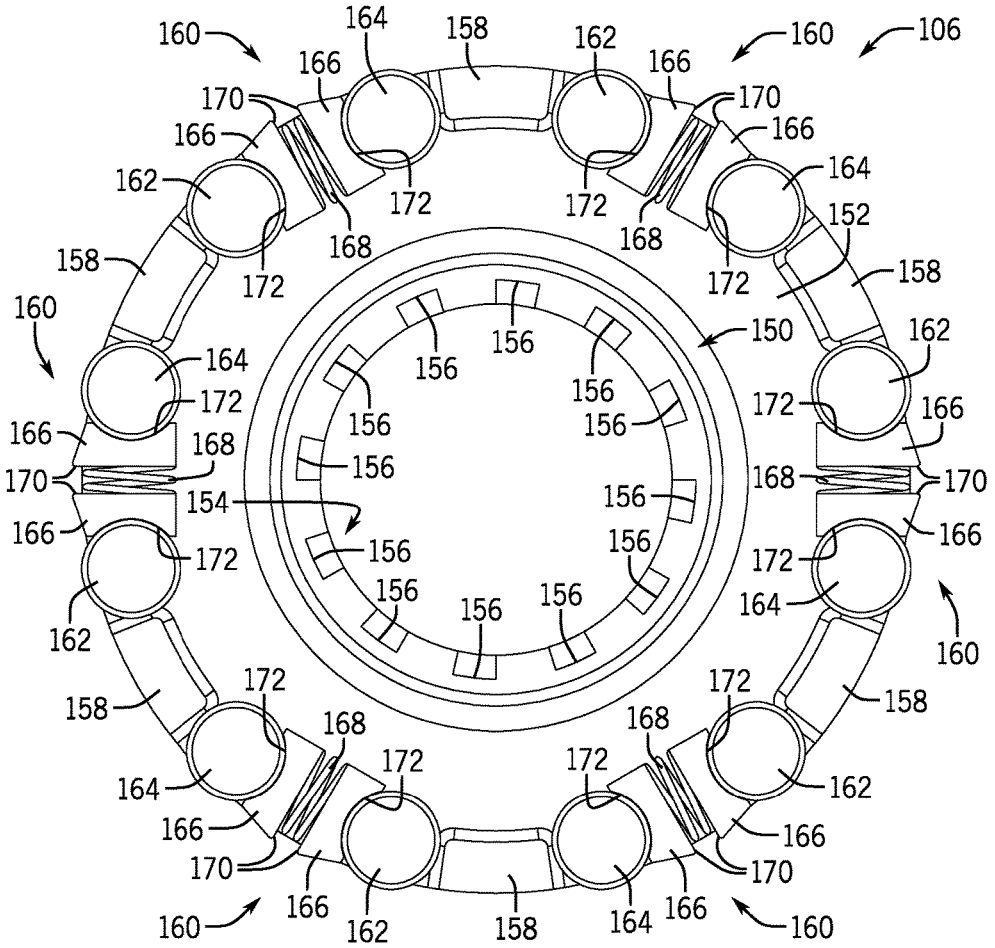
FIG. 17 is a back view of a spider rotor and a plurality of locking assemblies of the cam phasing system of FIG. 11 with plurality of locking assemblies assembled.
Figure 18:
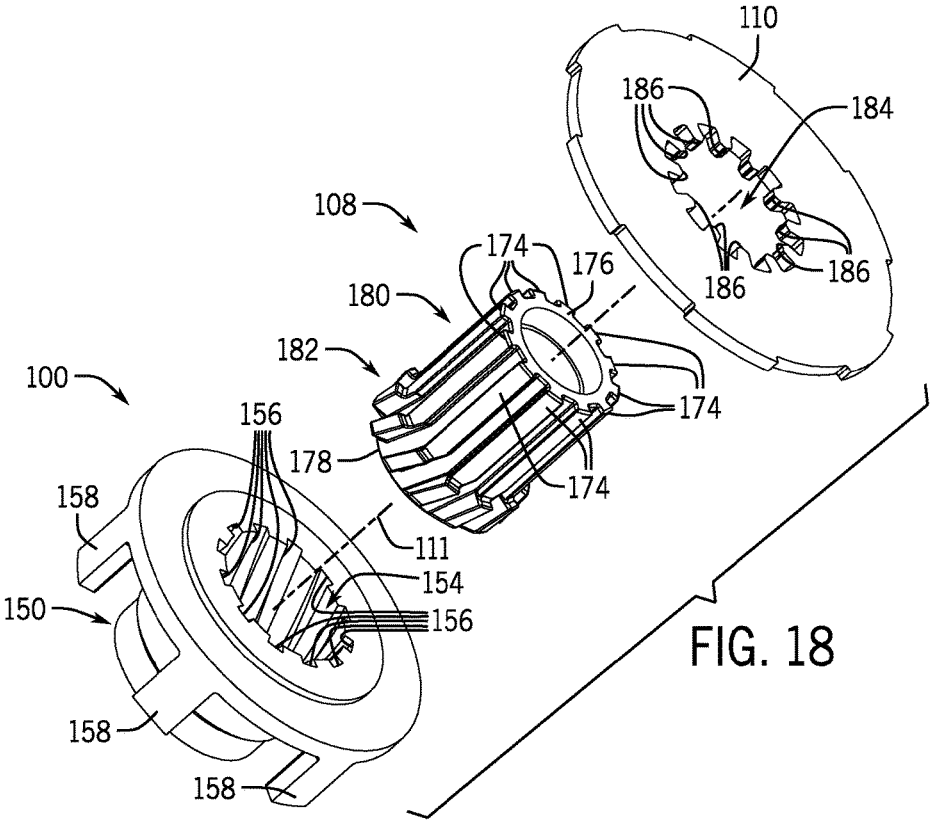
FIG. 18 is an exploded top, front, right isometric view of a spider rotor, a helix rod, and an end plate of the cam phasing system of FIG. 11.

Turing to FIGS. 16-18, the spider rotor 106 can include a central hub 150 extending axially outward from a front surface 152 of the spider rotor 106. The central hub 150 can include an inner bore 154 that extends axially through the spider rotor 106. The inner bore 154 can include a plurality of helix features 156 arranged circumferentially around the inner bore 154. In the illustrated non-limiting example, the plurality of helix features 156 each define a radially recessed slot in the inner bore 154, which define a helical profile as they extend axially along the inner bore 154. The illustrated helix features 156 each define a generally rectangular shape in cross-section.

A plurality of arms 158 can extend axially from a periphery of the front surface 152 in the same direction as the central hub 150. The plurality of arms 158 can be arranged circumferentially around the periphery of the front surface 152. The illustrated spider rotor 106 can include six arms 158 arranged in approximately 60 degree increments around the periphery of the front surface 152. In other embodiments, the spider rotor 106 may include more or less than six arms 158 arranged circumferentially in any increment around the periphery of the front surface 152, as desired. The plurality of arms 158 can be spaced circumferentially around the periphery of the front surface 152 such that a gap can exist between adjacent arms 158. Each gap can be dimensioned such that a corresponding one of a plurality of locking assemblies 160 can be arranged therein, as shown in FIG. 17.

Each of the plurality of locking assemblies 160 can include a first locking feature 162, a second locking feature 164, and corresponding locking feature supports 166 in engagement with a corresponding one of the first and second locking features 162 and 164. The first locking feature 162 and the second locking feature 164 can be forced away from each other by one or more biasing members 168. The illustrated locking assemblies 160 each can include one biasing member 168 in the form of a spring. In other embodiments, the plurality of locking assemblies 160 each may include more than one biasing member 168, and/or the biasing member 168 may be in the form of any viable mechanical linkage capable of forcing the first locking feature 162 and the second locking feature 164 away from each other. The biasing member 168 can be arranged between and in engagement with corresponding pairs of the locking feature supports 166 thereby forcing the first and second locking features 162 and 164 away from each other.

The locking features supports 166 each can include a generally flat surface 170 in engagement with the biasing member 168 and a generally conforming surface 172. The illustrated first and second locking features 162 and 164 can be in the form of round roller bearings. Thus, the generally conforming surfaces 172 of the locking feature supports 166 each can define a generally round, or semi-circular, shape. It should be appreciated that the first and second locking features 162 and 164 may define any shape that enables locking the cradle rotor 104. It should also be appreciated that alternative mechanisms are possible for the first and second locking features 162 and 164 other than a bearing. For example, the first and second locking features 50 and 52 may be in the form of wedged features.

With specific reference to FIG. 18, the helix rod 108 can include a plurality of splines 174 protruding radially outward from an outer surface thereof. The plurality of splines 174 can be continuously arranged circumferentially around the helix rod 108 such that the entire circumference of the helix rod 108 is uniformly distributed with the plurality of splines 174. The plurality of splines 174 can extend axially along the helix rod 108 from a first helix end 176 to a second helix end 178. Each of the plurality of splines 174 can define a linear portion 180 and a helical portion 182. The linear portion 180 can extend in a direction substantially parallel to the central axis 111 from the first helix end 176 to a location between the first helix end 176 and the second helix end 178. The helical portion 182 can extend in a direction generally transverse to the central axis 111 to conform to the helical pattern defined by the helical features 156 of the spider rotor 106. The helical portion 182 can extend from the location where the linear portion 180 stops to the second helix end 178. The helical portion 182 can define a step change in radial thickness defined by the plurality of splines 174. The illustrated helical portion 182 can define an increased radial thickness compared to a radial thickness defined by the linear portion 180. In other embodiments, the linear portion 180 and the helical portion 182 can define a generally uniform radial thickness.

The end plate 110 can define a generally annular shape and includes a central aperture 184. The central aperture 184 can define a generally spline-shaped pattern that corresponds with the linear portion 180 of the helix rod 108. That is, the central aperture 184 can include a plurality of splined protrusions 186 extending radially inward and arranged circumferentially around the central aperture 184. The central aperture 184 can be configured to receive the linear portion 180 of the helix rod 108. When assembled, the linear portion 180 of the helix rod 108 extends through the central aperture 184 and the interaction between the plurality of splines 174 on the helix rod 108 and the plurality of splined protrusions 186 on the central aperture 184 can maintain the helix rod 108 in a consistent orientation relative to the end plate 110. The end plate 110 is configured to be rigidly attached to the sprocket hub 102 such that the end plate 110 cannot rotate relative to the sprocket hub 102.

The helical portion 182 of the helix rod 108 is configured to be received within the helical features 156 of the spider rotor 106. An interaction between the helical portion 182 of the helix rod 108 and the helical features 156 of the spider rotor 106 can enable the spider rotor 106 to rotate relative to the sprocket hub 102 in response to an axial displacement applied by the actuation mechanism 124 on the helix rod 108. When assembled, as shown in FIG. 13, the spider rotor 106 can be constrained such that it cannot displace axially. Thus, in response to an axial displacement applied on the helix rod 108 by the actuation mechanism 124, the spider rotor is forced to rotate relative to the sprocket hub 102 due to the interaction between the helical portion 182 of the helix rod 108 and the helical features 156 of the spider rotor 106.

Figure 19:
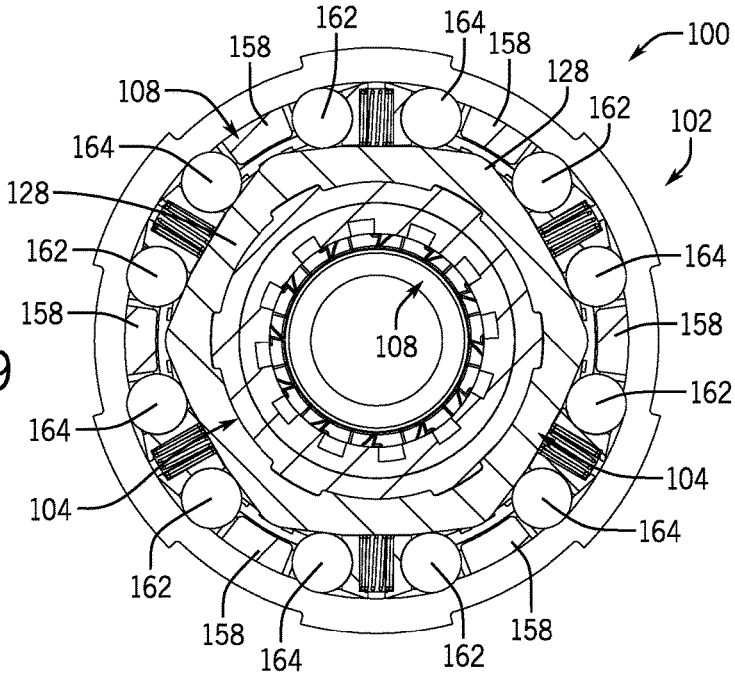
FIG. 19 is back view of the cam phasing system of FIG. 11 with an end plate of the cam phasing system transparent.

Operation of the cam phasing system 100 can be similar to the operation of the cam phasing system 10, described above. The design and configuration of the cam phasing system 100 may be different than the cam phasing system 10; however, the operations principles remain similar. That is, when the rotational relationship between the cam shaft, which is fastened to the cradle rotor 104, and the crank shaft, which is coupled to the sprocket hub 102, is desired to be altered, the ECM of the internal combustion engine can instruct the actuation mechanism 124 to provide an axial displacement to the helix rod 108 in a desired direction. When the signal is sent to axially displace the helix rod 108, the cam phasing system 100 can transition from a locked state (FIG. 19), where the rotational relationship between the cradle rotor 104 and the sprocket hub 102 is locked, to an actuation state. In response to the axial displacement applied to the helix rod 108, the spider rotor 106 can rotate, either clockwise or counterclockwise depending of the direction of the axial displacement, due to the interaction between the helical portion 182 of the helix rod 108 and the helical features 156 of the spider rotor 106. The rotation of the spider rotor 106 can cause the plurality of arms 158 of the spider rotor 106 to engage and rotationally displace one of the first locking features 162 or the second locking features 164 thereby unlocking one of the first locking features 162 or the second locking features 164. The other one of the first locking features 162 or the second locking features 164, not engaged by the plurality of arms 158, remain in a locked position. With one of the first locking features 162 or the second locking features 164 in an unlocked position, the cradle rotor 104 can rotationally follow the spider rotor 106 by harvesting cam torque pulses applied to the cradle rotor 104 in the same direction that the spider rotor 106 was rotated. Since the other one of the first locking features 162 or the second locking features 164 remain in a locked position, cam torque pulses applied to the cradle rotor 104 in a direction opposite to the direction that the spider rotor 106 was rotated will not rotationally displace the cradle rotor 104. The cradle rotor 104 can continue harvesting cam torque pulses until, eventually, the cradle rotor 104 rotationally displaces enough such that the one of the first locking features 162 or the second locking features 164 in the unlocked position return to a locked position, as shown in FIG. 19. When this occurs, the first and second locking features 162 and 164 can both be in the locked position and the cam phasing system 100 can return to a locked state. Thus, the cam phasing system 100 enables the rotational relationship between the cam shaft and the crank shaft to be varied a desired rotational amount.

Thus, independent of the engine speed and cam torque pulse magnitude, the present invention provides systems and methods for accurately controlling a rotary position of a first component (e.g., the spider rotor 106) with a mechanism causing a second component (e.g., the cradle rotor 104), which can be coupled to the cam shaft or crank shaft, to follow the rotary position of the first component to alter a rotational relationship between a cam shaft and a crank shaft on an internal combustion engine.

Figure 20:
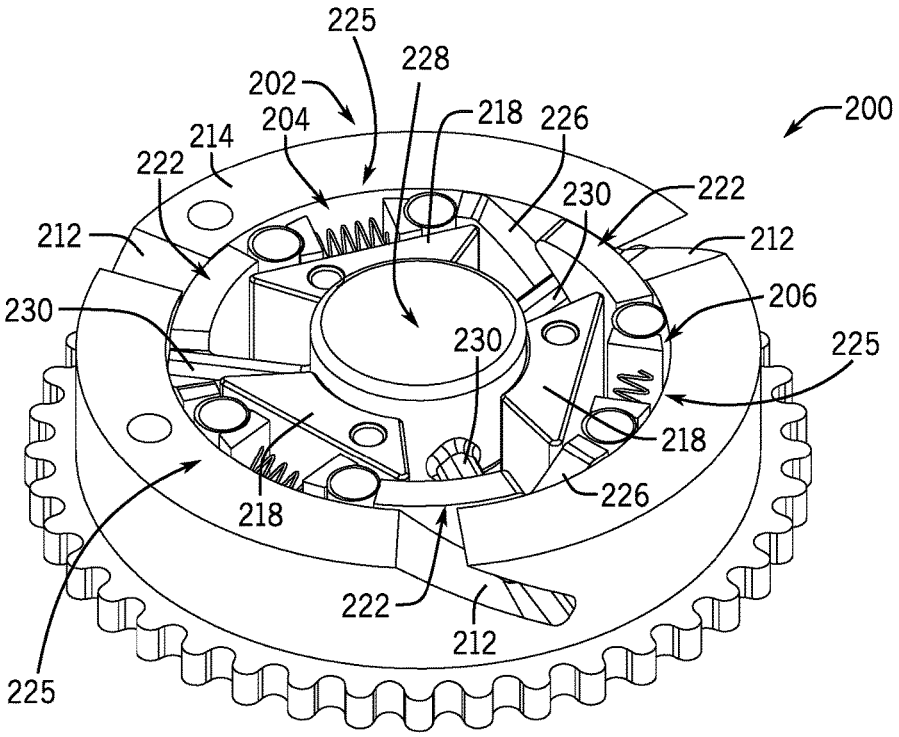
FIG. 20 is a bottom, front, left isometric view of a cam phasing system according to another embodiment of the present invention.
Figure 21:
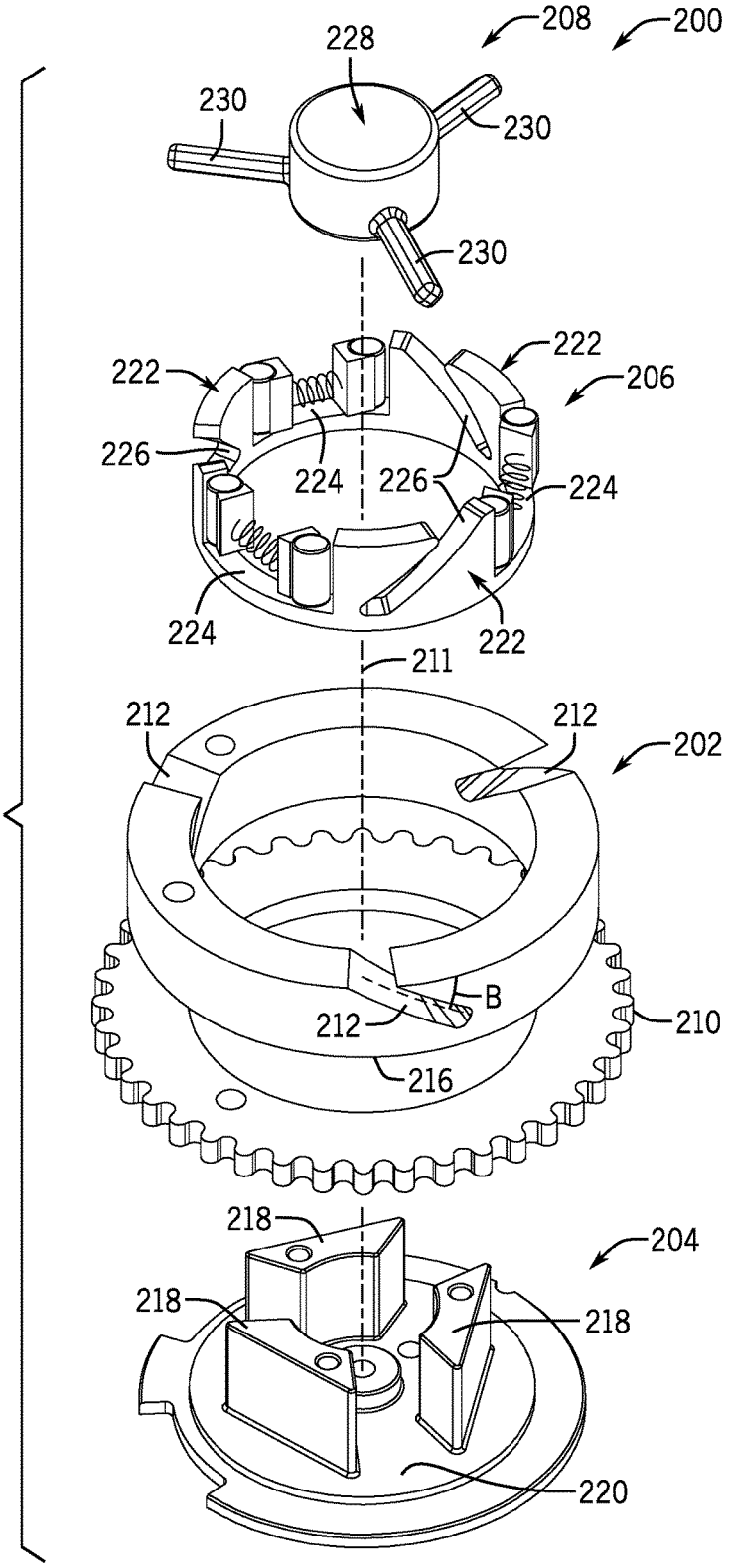
FIG. 21 is an exploded top, front, left isometric view of the cam phasing system of FIG. 20.
Figure 22:
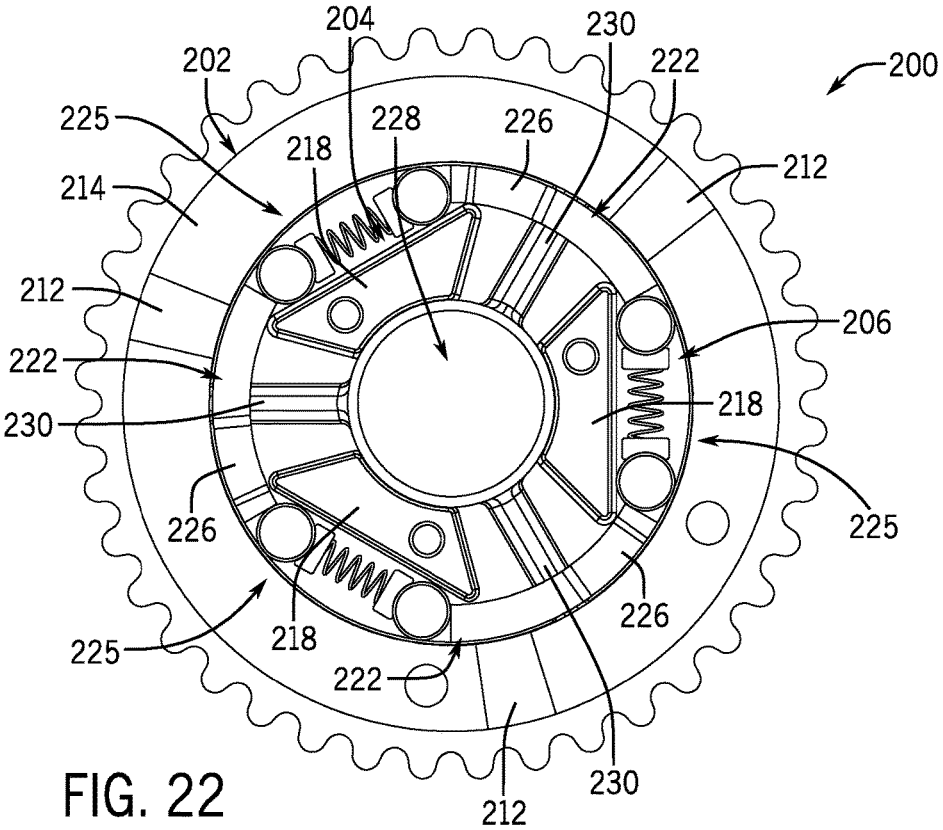
FIG. 22 is a front view of the cam phasing system of FIG. 20.

Again, it should be appreciated by one of skill in the art that alternative designs and configurations are possible to provide accurate control of a rotary position of a first component with a mechanism causing a second component, which can be coupled to the cam shaft or crank shaft, to follow the rotary position of the first component. For example, in some embodiments, a cam phasing system may not include an end plate and, therefore, a helix rod may be allowed to rotate relative to a sprocket hub as it is axially displaced. FIGS. 20-22 show one embodiment of such a cam phasing system 200 according to still another embodiment of the present invention. The cam phasing system 200 can include a sprocket hub 202, a cradle rotor 204, a spider rotor 206, and a helix rod 208. The sprocket hub 202 can be attached to a gear 210, which is configured to be coupled to a crank shaft of an internal combustion engine. The sprocket hub 202, the cradle rotor 204, the spider rotor 206, and the helix rod 208 can each share a common central axis 211, when assembled.

The sprocket hub 202 can include a plurality of angled slots 212 arranged circumferentially around the sprocket hub 202. Each of the plurality of angled slots 212 can extend axially into the sprocket hub 202 at an angle relative to a front surface 214 of the sprocket hub 202. That is, an angle B can be defined between a centerline defined by the respective angled slot 212 and the front surface 214. Each of the plurality of angled slots 212 can extend axially at the angle B into the sprocket hub 202 from the front surface 214 to a location between the front surface 214 and a back surface 216 of the sprocket hub 202. The illustrated sprocket hub 202 can include three angled slots 212 arranged circumferentially around the sprocket hub 202 at approximately 120 degree increments. In other embodiments, the sprocket hub 202 can include more or less than three angled slots 212 arranged circumferentially around the sprocket hub 202 at any increments.

The cradle rotor 204 can include a plurality of angled wedging members 218 extending axially from a front surface 220 of the cradle rotor 204. The plurality of angled wedging members 218 can be similar to the plurality of angled wedging members 38, described above for the cam phasing system 10.

The spider rotor 206 can define a generally annular shape and can include a plurality of arms 222 extending axially from a front surface 224 of the spider rotor 206. The plurality of arms 222 can be arranged circumferentially around the front surface 224. The illustrated spider rotor 208 can include three arms 222 arranged in approximately 120 degree increments around the front surface 224. In other embodiments, the spider rotor 206 may include more or less than three arms 222 arranged circumferentially in any increment around the periphery of the front surface 224. The plurality of arms 222 can be spaced circumferentially around the front surface 224 such that a gap can exist between adjacent arms 222. Each gap can be dimensioned such that a corresponding locking assembly 225 can be arranged therein. The locking assemblies that can be arranged within the gaps between adjacent arms 222 of the spider rotor 208 may be similar to the locking assemblies 20 and 160, described above. Alternatively, the locking assemblies may include wedged features similar to those shown in FIG. 8.

Each of the plurality of arms 222 can include a helical feature 226. The illustrated helical features 226 can be in the form of a helical slot extending axially into the arm 222. The helical features 226 can be formed in the spider rotor 206 such that, when assembled, the helical features 226 are arranged transverse to the angled slots 212 of the sprocket hub 202.

The helix rod 208 can include a central hub 228 and a plurality of posts 230 extending radially outward from a periphery the central hub 228. The illustrated helix rod 208 can include three posts 230 arranged in approximately 120 degree increments around the periphery of the central hub 228. In other embodiments, the helix rod 208 may include more or less than three posts 230 arranged circumferentially in any increment around the periphery of the central hub 228. When assembled, each of the plurality of posts 230 can be extend through a corresponding one of the plurality of helical features 226 of the spider rotor 208 and a corresponding one of the plurality of angles slots 212 of the sprocket hub 202. This can couple the helix rod 208, the spider rotor 206 and the sprocket hub 202 such that, when an axial force is applied to the helix rod 208 (e.g., via an actuation mechanism coupled thereto), the spider rotor 206 can rotate relative to the sprocket hub 202.

Operation of the cam phasing system 200 can be similar to the operation of the cam phasing systems 10 and 100, described above, except that, unlike the cam phasing system 100, the helix rod 208 can rotate relative to the sprocket hub 202 as it is displaced axially (e.g., via an actuation mechanism coupled thereto). Thus, independent of the engine speed and cam torque pulse magnitude, the present invention provides systems and methods for accurately controlling a rotary position of a first component (e.g., the spider rotor 206) with a mechanism causing a second component (e.g., the cradle rotor 204), which can be coupled to the cam shaft or crank shaft, to follow the rotary position of the first component to alter a rotational relationship between a cam shaft and a crank shaft on an internal combustion engine.

Figure 23:
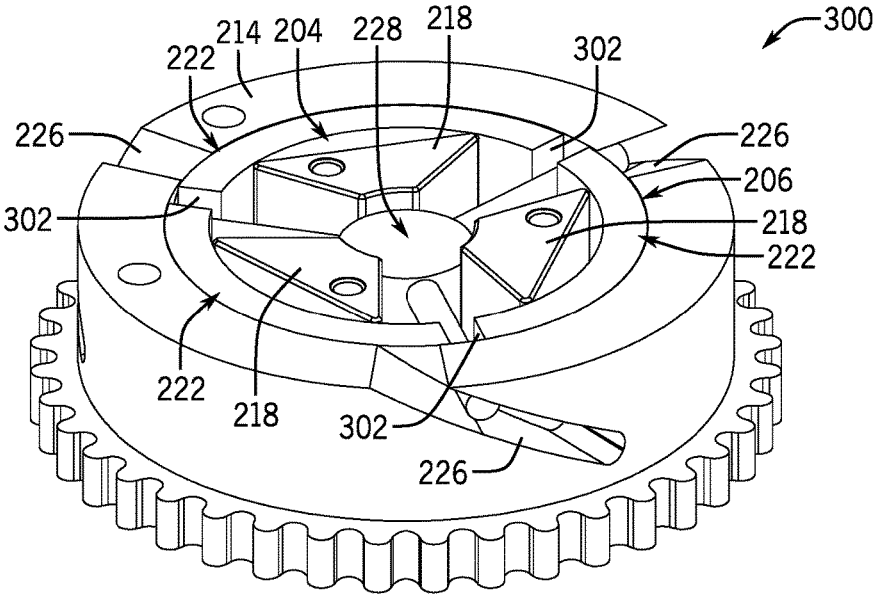
FIG. 23 is a bottom, front, left isometric view of a cam phasing system according to another embodiment of the present invention.
Figure 24:
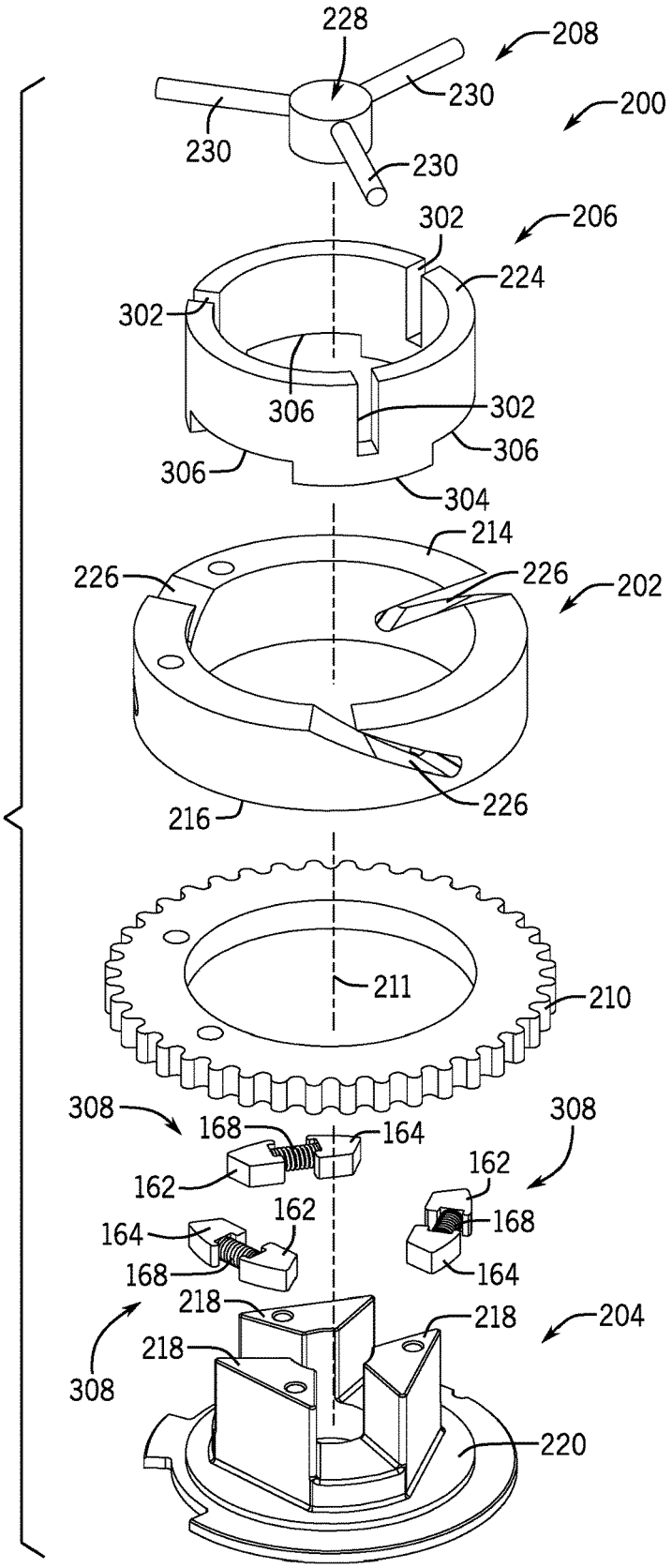
FIG. 24 is an exploded top, front, left isometric view of the cam phasing system of FIG. 23.
Figure 25:
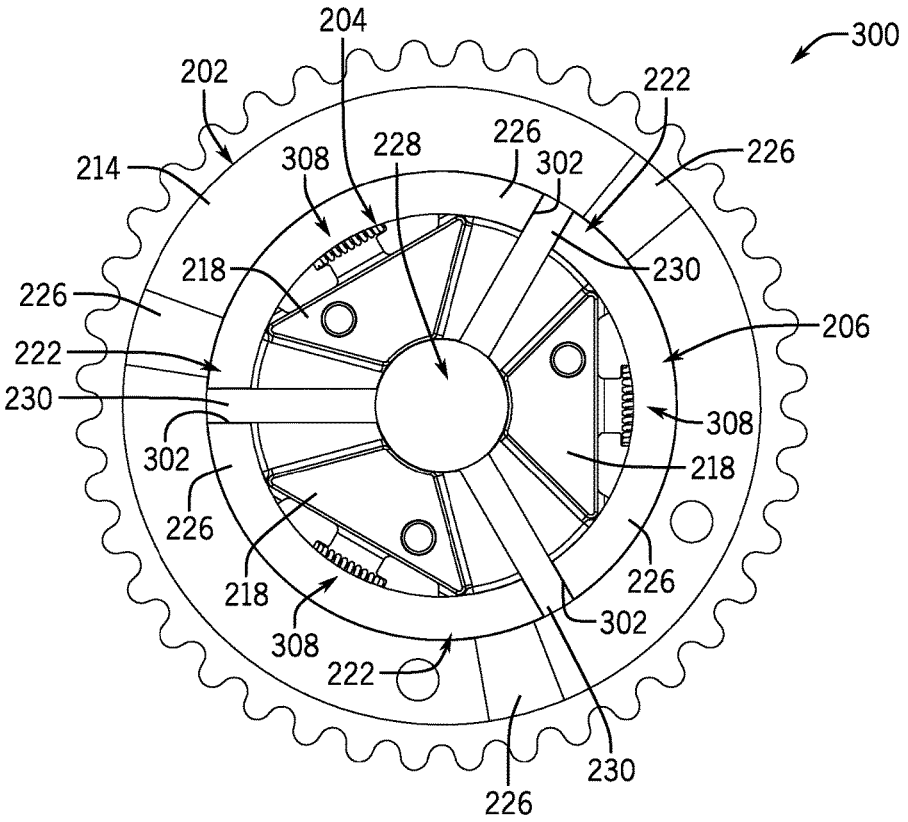
FIG. 25 is a front view of the cam phasing system of FIG. 23.
Figure 26:
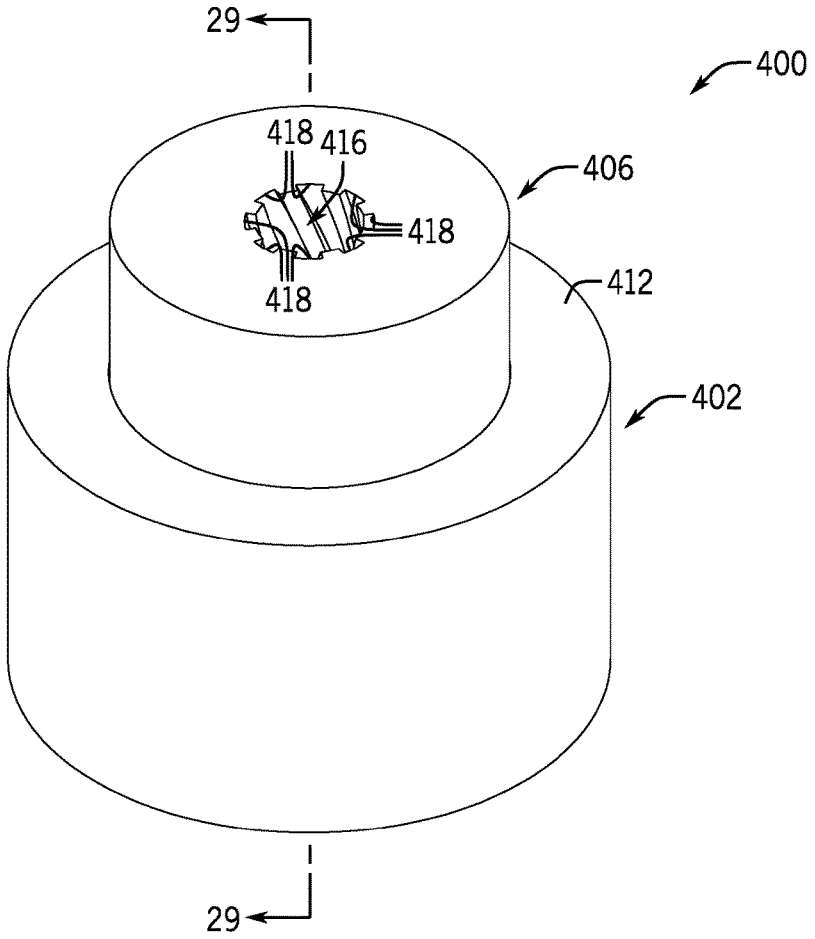
FIG. 26 is a top, front, left isometric view of a cam phasing system according to another embodiment of the present invention.
Figure 27:
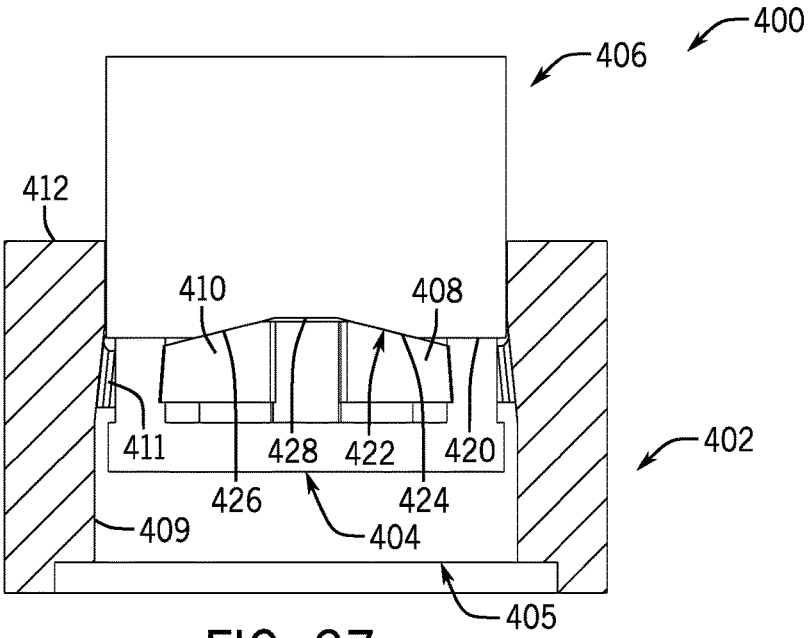
FIG. 27 is a partial cross-sectional view of the cam phasing system of FIG. 26 with a sprocket hub shown in cross-section to illustrate the components arranged therein.
Figure 28:
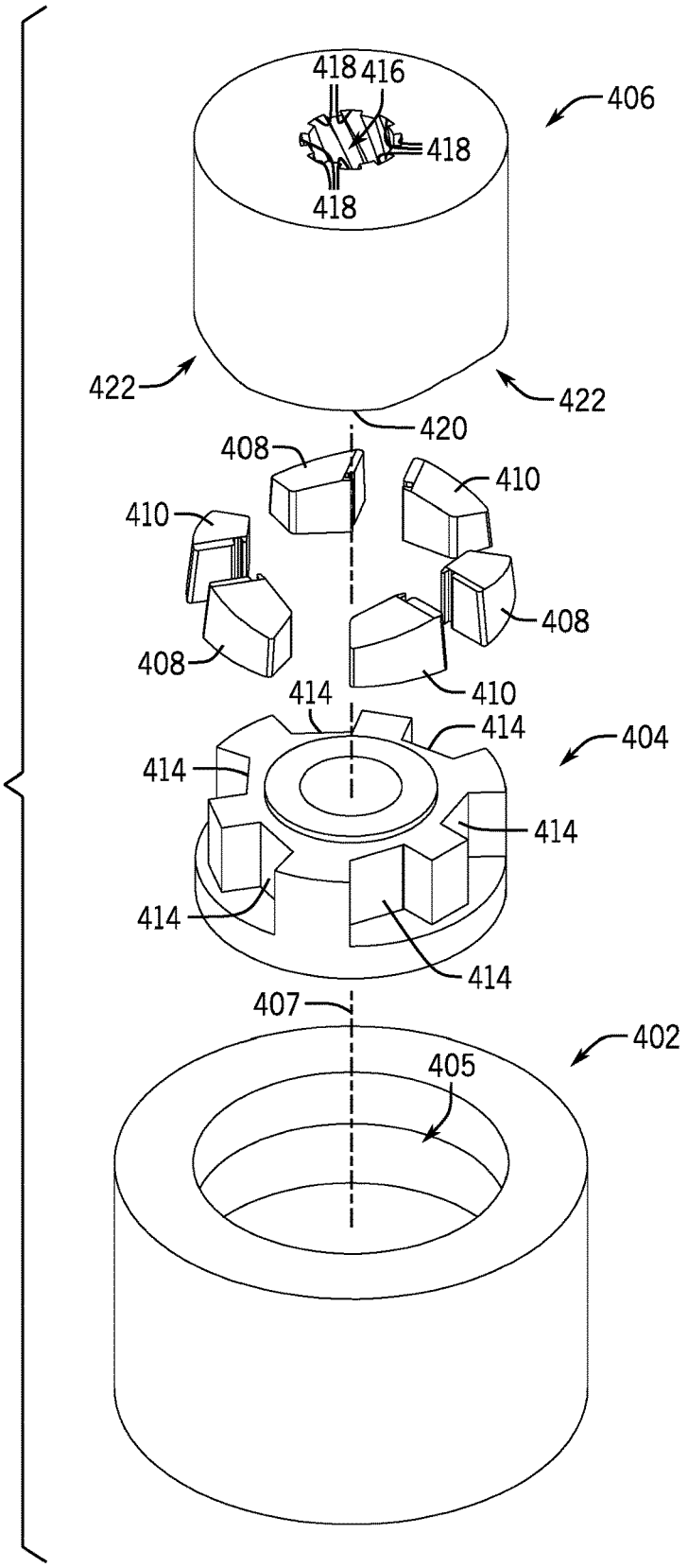
FIG. 28 is an exploded top, front, left isometric view of the cam phasing system of FIG. 26.
Figure 29:
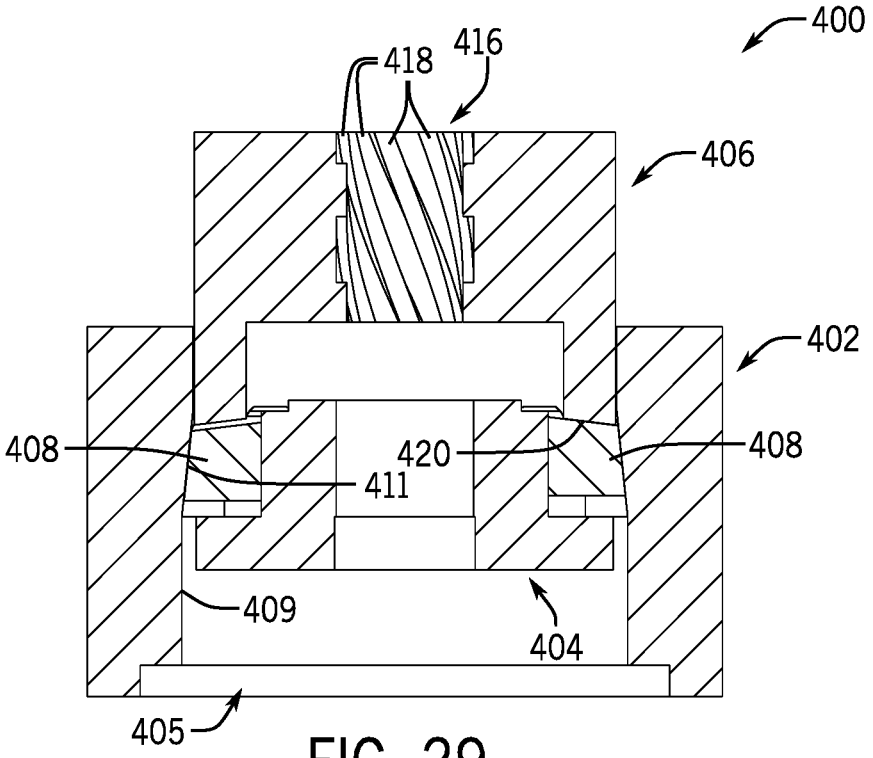
FIG. 29 is a cross-sectional view of the cam phasing system of FIG. 26 taken along line 29-29.

FIGS. 23-25 show a cam phasing system 300 according to yet another embodiment of the present invention. The cam phasing system 300 is similar in design and operation to the cam phasing system 200, described above, except as illustrated by FIGS. 23-25 or described below. Similar components between the cam phasing system 200 and the cam phasing system 300 are identified using like reference numerals.

As shown in FIGS. 23-25, the spider rotor 206 can include a plurality of axial slots 302 as opposed to the plurality of helical features 226. The plurality of helical features 226 can be arranged circumferentially around the sprocket hub 202 in place of the plurality of angled slots 212. Each of the plurality of axial slots 302 can extend axially into the spider rotor 206 in a direction substantially parallel to the central axis 211. Each of the plurality of axial slots 302 can extend from the front surface 224 towards a back surface 304 of the spider rotor 206 to a location between the front surface 224 and the back surface 304. The back surface 304 can include a plurality of cutouts 306 arranged circumferentially around the back surface 304. Each of the plurality of cutouts 306 can be dimensioned to receive a corresponding one of a plurality of locking assemblies 308. The plurality of locking assemblies can be similar in functionality to the locking assemblies 20 and 160, described above.

The locking assemblies described herein (e.g., the locking assemblies 20 and/or 160) can switch between a locked position and an unlocked position by moving rotationally, or circumferentially. However, it should be appreciated that locking assemblies that move between a locked position and an unlocked position by moving axially are within the scope of the present invention. For example, FIGS. 26-30 show a cam phasing system 400 according to another embodiment of the present disclosure. As shown in FIGS. 26-29, the cam phasing system 400 can include a sprocket hub 402, a cradle rotor 404, a spider rotor 406 and a plurality of first and second locking wedges 408 and 410. The sprocket hub 402, the cradle rotor 404, and the spider rotor 406 can each share a common central axis 407, when assembled. The sprocket hub 402 can be configured to be coupled to a crank shaft of an internal combustion engine, for example, via a belt, chain, or gear train assembly.

The sprocket hub 402 can define a generally annular shape and can include an inner bore 405 having a straight portion 409 and a tapered portion 411. The straight portion 409 of the inner bore 405 can be arranged generally parallel to the central axis 407. The tapered portion 411 of the inner bore 404 can taper radially inward towards the central axis 407 as the tapered portion 411 extends axially towards a first end 412 of the sprocket hub 402. When assembled, each of the plurality of first and second locking wedges 408 and 410 can be arranged in engagement with the tapered portion 411 of the sprocket hub 402, and can be configured to translate axially along the tapered portion 411, as will be described below.

The cradle rotor 404 can be configured to be fastened to a cam shaft of the internal combustion engine. The cradle rotor 404 can define a generally annular shape and can include a plurality of cutouts 414 arranged around a periphery thereof. Each of the plurality of cutouts 414 can be dimensioned to slideably receive a corresponding one of the plurality of first locking wedges 408 or a corresponding one of the plurality of second locking wedges 410. During operation, each of the plurality of first and second locking wedges 408 and 410 can be configured to translate axially within a respective one of the plurality of cutouts 414 in which they are received.

The spider rotor 406 can define a generally annular shape and can include an inner bore 416 that extends axially through the spider rotor 406. The inner bore 416 can include a plurality of helical features 418 arranged circumferentially around the inner bore 416. In the illustrated non-limiting example, the plurality of helical features 418 can each define a radially recessed slot in the inner bore 416, which define a helical profile as they extend axially along the inner bore 416.

A bottom surface 420 of the spider rotor 406 can include a plurality of tapered sections 422 arranged circumferentially around the bottom surface 420. Each of the tapered section 422 can include a first tapered surface 424, a second tapered surface 426, and a flat surface 428 arranged therebetween. Each of the first tapered surfaces 424 and the second tapered surfaces 426 can taper axially towards a top surface 430 of the spider rotor 406. When assembled, each of the first tapered surfaces 424 can be in engagement with a corresponding one of the plurality of first locking wedges 408 and each of the second tapered surfaces 426 can be in engagement with a corresponding one of the plurality of second locking wedges 410. The engagement between the first tapered surfaces 424 and their respective one of the plurality of first locking wedges 408, and the engagement between the second tapered surfaces 426 and their respective one of the plurality of second locking wedges 410 enables the spider rotor 406 to selectively displace one of the plurality of first and second locking wedges 408 and 410 the axially, when the spider rotor 406 is rotated, which in turn controls the locking and unlocking of the plurality of first and second locking wedges 408 and 410.

Operation of the cam phasing system 400 will be described with reference to FIGS. 26-30. In operation, the cam phasing system 400 can include a helix rod (not shown) including helical features configured to be received within the inner bore 416 of the spider rotor 406. The helix rod (not shown) can be received within an end plate (not shown) that includes spline features configured to hold the helix rod (not shown) in a constant rotational orientation. This functionality of the helix rod (not shown), end plate (not shown), and the spider rotor 406 can be similar to the spider rotor 106, the helix rod 108, and the end plate 110, described above, and shown in FIG. 18.

Figure 30:
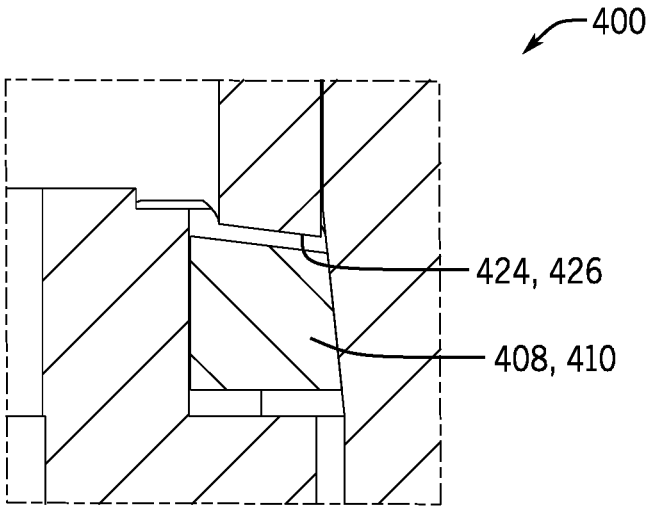
FIG. 30 is an enlarged portion of the cross-sectional view of FIG. 29 showing a locking features in an unlocked position.

When the rotational relationship between the cam shaft, which is fastened to the cradle rotor 404, and the crank shaft, which is coupled to the sprocket hub 402, is desired to be altered, the ECM of the internal combustion engine can instruct an actuation mechanism to axially displace the helix rod (not shown) in a desired direction. When the signal is sent to axially displace the helix rod (not shown), the cam phasing system 400 can transition from a locked state, where the rotational relationship between the cradle rotor 404 and the sprocket hub 402 is locked, to an actuation state. In response to the displacement of the helix rod (not shown), the spider rotor 406 can be forced to rotate, either clockwise or counterclockwise depending of the direction of the axial displacement, due to the interaction between the helical features 418 of the spider rotor 406 and helical features in the helix rod (not shown). Rotation of the spider rotor 406 can cause one of the first tapered surfaces 424 or the second tapered surfaces 426 (depending on the direction or rotation) to engage the respective one of the plurality of first locking wedges 408 or the plurality of second locking wedges 410 as the spider rotor 406 rotates. The geometry of the first tapered surfaces 424 and the second tapered surfaces 426 can cause the respective one of the plurality of first locking wedges 408 or the plurality of second locking wedges 410 to displace axially, in response to the rotation of the spider rotor 406, as shown in FIG. 30.

The axial displacement of the respective one of the plurality of first locking wedges 408 or the plurality of second locking wedges 410 can move the respective one of the respective one of the plurality of first locking wedges 408 or the plurality of second locking wedges 410 from a locked position to an unlocked position. In the unlocked position, an axial gap can exist between the unlocked one of the plurality of first locking wedges 408 or the plurality of second locking wedges 410 and the respective one of the first tapered surfaces 424 or the second tapered surfaces 426, as shown in FIG. 30. Simultaneously, the other one of the plurality of first locking wedges 408 or the plurality of second locking wedges 410 can remain in a locked position. The cradle rotor 404 can then harvest cam torque pulses, applied in the same direction as the rotation of the spider rotor 402, to rotate relative to the sprocket hub 402. Again, as with the cam phasing systems 10 and 100 described above, the locked position of the other one of the plurality of first locking wedges 408 or the plurality of second locking wedges 410 can enable cam torque pulses applied to the cradle rotor 404 in a direction opposite to the direction that the spider rotor 406 was rotated to not rotationally displace the cradle rotor 404. Similar to the cam phasing system 10 and 100, the cradle rotor 404 can continue harvesting cam torque pulses until, eventually, the cradle rotor 404 rotationally displaces enough such that the one of the plurality of first locking wedges 408 or the plurality of second locking wedges 410 in the unlocked position return to a locked position. When this occurs, the first and second plurality of locking wedges 408 and 410 can both be in the locked position and the cam phasing system 400 can return to a locked state, and the rotational relationship between the cam shaft and the crank shaft can be varied a desired rotational amount.

Thus, independent of the engine speed and cam torque pulse magnitude, the present invention provides systems and methods for accurately controlling a rotary position of a first component (e.g., the spider rotor 406) with a mechanism causing a second component (e.g., the cradle rotor 404), which can be coupled to the cam shaft or crank shaft, to follow the rotary position of the first component to alter a rotational relationship between a cam shaft and a crank shaft on an internal combustion engine.

Figure 31:
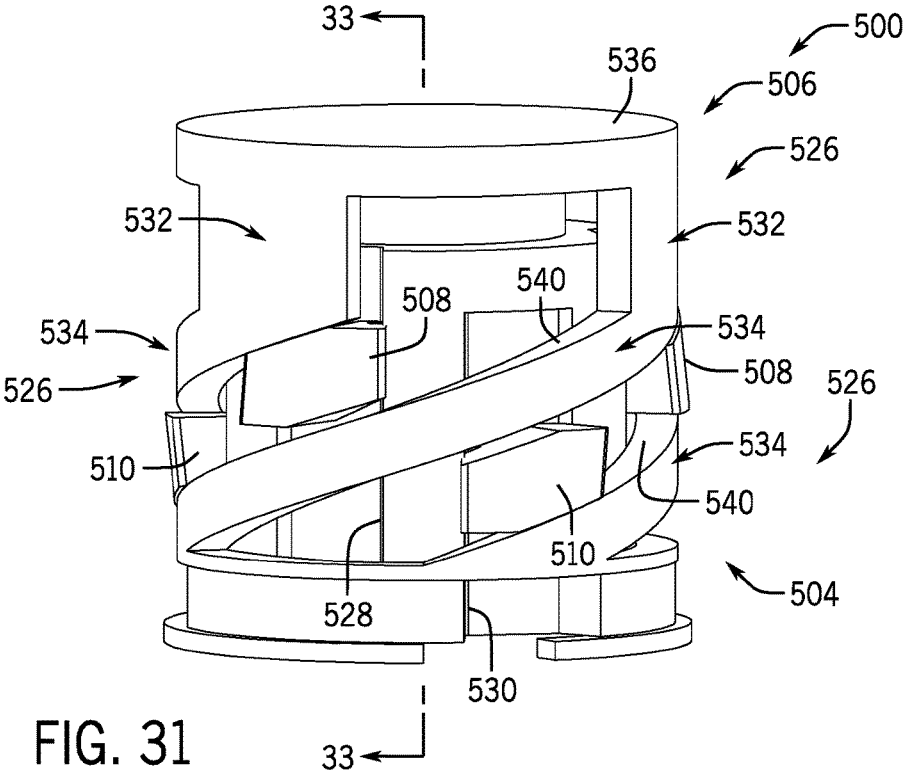
FIG. 31 is top, front, left isometric view of a cam phasing system according to another embodiment of the present invention with a sprocket hub transparent.
Figure 32:
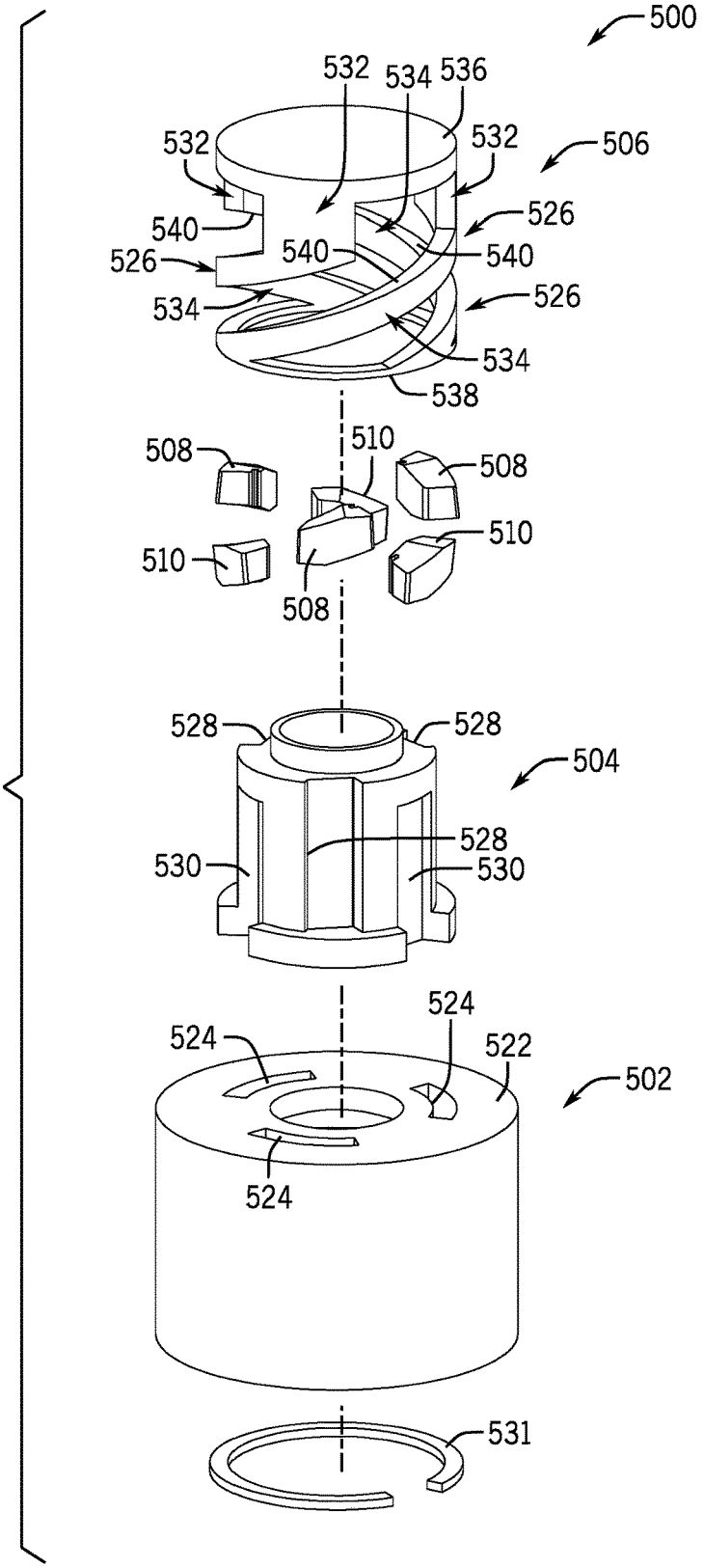
FIG. 32 is an exploded top, front, left isometric view of the cam phasing system of FIG. 31.
Figure 33:
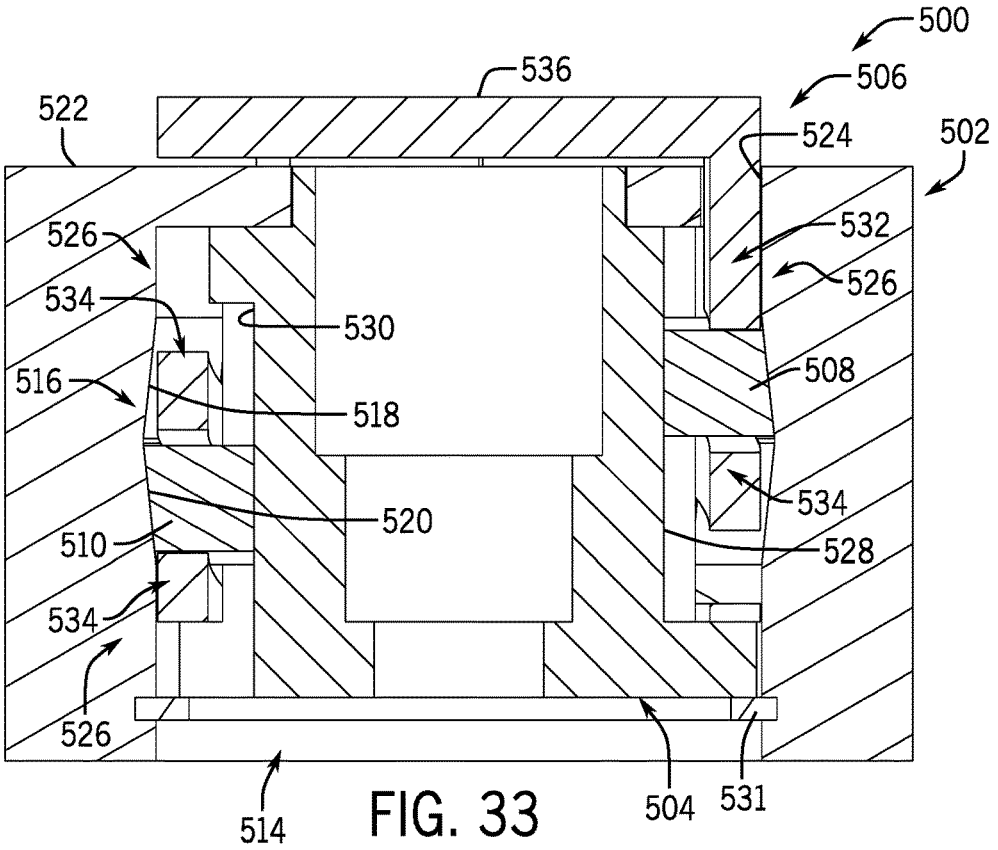
FIG. 33 is a cross-sectional view of the cam phasing system of FIG. 31 taken along line 33-33.
Figure 34:
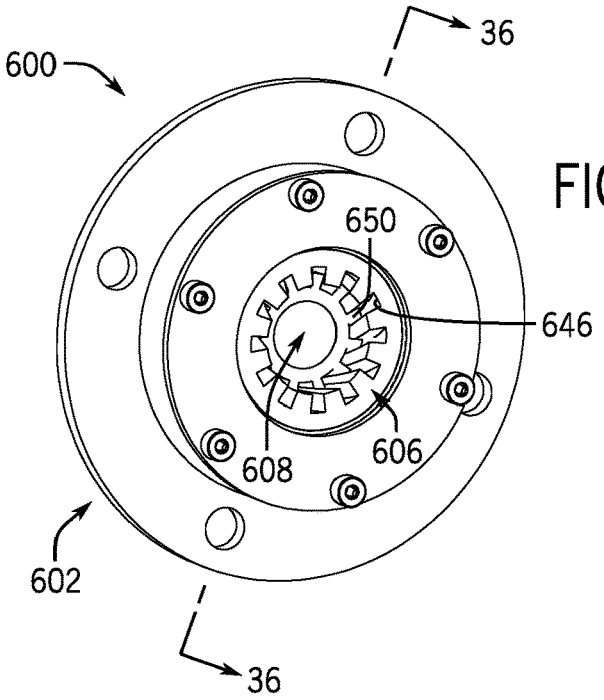
FIG. 34 is a top, front, left isometric view of a cam phasing system according to another embodiment of the present invention.
Figure 35:
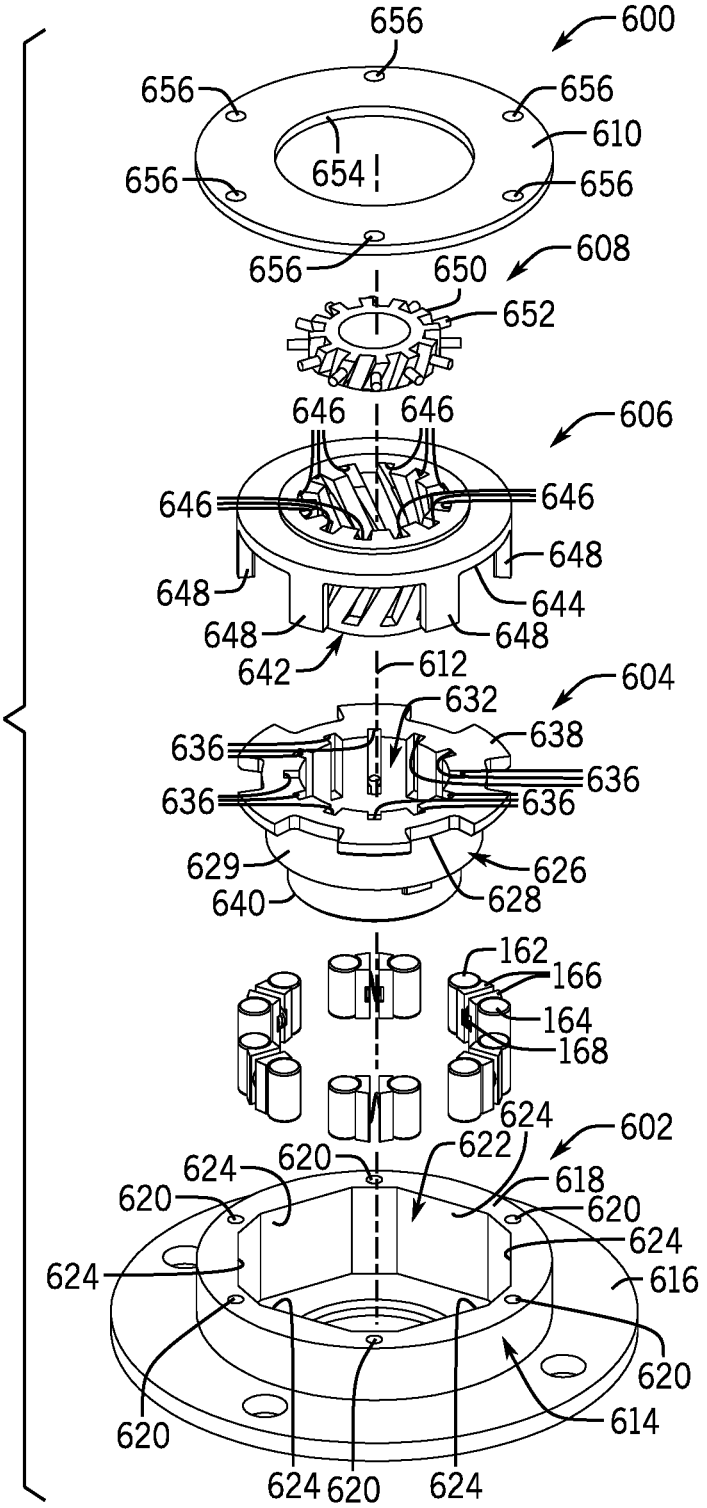
FIG. 35 is an exploded top, front, left isometric view of the cam phasing system of FIG. 34.

It should be appreciated by one of skill in the art that alternative designs and configurations are possible to achieve the axial locking and unlocking provided by the cam phasing system 400. For example, FIGS. 31-33 show a cam phasing system 500 according to still another embodiment of the present invention. As shown in FIGS. 31-33, the cam phasing system 500 can include a sprocket hub 502, a cradle rotor 504, a spider rotor 506 and a plurality of first and second locking wedges 508 and 510. The sprocket hub 502, the cradle rotor 504, and the spider rotor 506 can each share a common central axis 512, when assembled. The sprocket hub 502 can be configured to be coupled to a crank shaft of an internal combustion engine, for example, via a belt, chain, or gear train assembly.

The sprocket hub 502 can define a generally annular shape and can include an inner bore 514 having a tapered portion 516. The tapered portion 516 of the inner bore 514 can include a first tapered surface 518 and a second tapered surface 520. The first tapered surface 518 can taper radially outward from the central axis 512 as the first tapered surface 518 extends axially towards a first end 522 of the sprocket hub 502. The second tapered surface 520 can taper radially inward as the second tapered surface 520 extends from the end of the first tapered surface 518 towards the first end 522 of the sprocket hub 502. When assembled, each of the plurality of first locking wedges 508 can be in engagement with the first tapered surface 518 and each of the second locking wedges 510 can be in engagement with the second tapered surface 520. The first end 522 of the sprocket hub 502 can include a plurality of cutouts 524 that extend axially though the first end 522 of the sprocket hub 502. Each of the plurality of cutouts 524 can be configured to receive a corresponding helical feature 526 of the spider rotor 506, as will be described below.

The cradle rotor 504 can be configured to be fastened to a cam shaft of the internal combustion engine. The cradle rotor 504 can define a generally annular shape and can include a plurality of first slots 528 and a plurality of second slots 530 alternatingly arranged circumferentially around a periphery thereof. Each of the plurality of first slots 528 can be dimensioned to slideably receive a corresponding one of the plurality of first locking wedges 508 such that the plurality of first locking wedges 508 can translate axially within their respective first slot 528. Each of the plurality of second slots 530 can be dimensioned to slideably receive a corresponding one of the plurality of second locking wedges 510 such that the plurality of first locking wedges 510 can translate axially within their respective second slot 530. A snap ring 531 can be configured to axially constrain the cradle rotor 504 within the inner bore 514 of the sprocket hub 502, when assembled.

The spider rotor 506 can include the plurality of helical features 526. The plurality of helical features 526 can each include an axial portion 532 and a helical portion 534. Each of the axial portions 532 can extend axially in a direction substantially parallel to the central axis 512 from a first end 536 of the spider rotor 506 towards a second end 538 of the spider rotor 506. At a location between the first end 536 and the second end 538, the helical features 526 can transition from the axial portion 532 to the helical portion 534. Each of the helical portions 534 can extend helically from an end of the axial portion 532 to the second end 538.

The axial portions 532 of the helical features 526 can each be configured to be received within a respective one of the cutouts 524 formed on the first end 522 of the sprocket hub 502. When assembled, the interaction between the cutouts 524 and the axial portions 532 can prevent rotation of the spider rotor 506 relative to the sprocket hub 502 in response to an axial force applied to the spider rotor 506 (e.g., via an actuation mechanism coupled thereto).

The illustrated spider rotor 506 define cutouts 540 between adjacent helical features 526 that extend radially through the spider rotor 506. A shape of the cutouts 540 can conform to a profile defined by the shape between adjacent helical features 526 (i.e., each cutout 540 can define an axial portion and a helical portion). When assembled, each of the cutouts 540 can receive a respective pair of one of the first and second locking wedges 508 and 510 such that the first locking wedge 508 engages one of the helical portions 534 defining the cutout 540 and the second locking wedge 510 engages the other of the helical portions 534 defining the cutout 540. The engagement between the plurality of first and second locking wedges 508 and 510 and their respective one of the helical portions 534 of the helical features 526 enables the spider rotor 506 to selectively displace one of the plurality of first and second locking wedges 508 and 510 the axially, when the spider rotor 506 is rotated, which in turn controls the locking and unlocking of the plurality of first and second locking wedges 508 and 510.

Operation of the cam phasing system 500 will be described with reference to FIGS. 31-33. In operation, when the rotational relationship between the cam shaft, which can be fastened to the cradle rotor 504, and the crank shaft, which can be coupled to the sprocket hub 502, is desired to be altered, the ECM of the internal combustion engine can instruct an actuation mechanism to axially displace the spider rotor 506 in a desired direction. When the signal is sent to axially displace the spider rotor 506, the cam phasing system 500 can transition from a locked state, where the rotational relationship between the cradle rotor 504 and the sprocket hub 502 can be locked, to an actuation state. In response to the axial displacement applied to the spider rotor 506, the spider rotor 506 can be forced to displace axially relative to the sprocket hub 502 and can be restricted from rotating relative to the sprocket hub 502. Due to the geometry of the helical features 526, the first tapered surface 518, and the second tapered surface 520, the axial displacement of the spider rotor 506 can cause one of the plurality of first locking wedges 508 or the plurality of second locking wedges 510 (depending on the direction of the axial displacement) to displace axially within their respective first slot 528 or second slot 530 thereby moving from a locked position to an unlocked position. In the unlocked position, an axial gap can exist between the unlocked one of the plurality of first locking wedges 508 or the plurality of second locking wedges 510 and the respective helical portion 534 in which the unlocked one of the plurality of first locking wedges 508 or the plurality of second locking wedges 510 was in engagement with. Simultaneously, the other one of the plurality of first locking wedges 508 or the plurality of second locking wedges 510 can remain in a locked position.

The cradle rotor 504 can then harvest cam torque pulses, applied in a desired direction (i.e., in a rotational direction from the unlocked one of the plurality of first locking wedges 508 or the plurality of second locking wedges 510 to the locked one of the plurality of first locking wedges 508 or the plurality of second locking wedges 510), to rotate relative to the sprocket hub 502. The locked position of the other one of the plurality of first locking wedges 408 or the plurality of second locking wedges 410 can enable cam torque pulses applied to the cradle rotor 504 in a direction opposite to the desired direction to not rotationally displace the cradle rotor 504. The cradle rotor 504 can continue harvesting cam torque pulses until, eventually, the cradle rotor 504 rotationally displaces enough such that the one of the plurality of first locking wedges 508 or the plurality of second locking wedges 510 in the unlocked position return to a locked position. When this occurs, the first and second plurality of locking wedges 508 and 510 can both be in the locked position and the cam phasing system 500 can return to a locked state, and the rotational relationship between the cam shaft and the crank shaft can be varied a desired rotational amount.

It should be appreciated that the geometry defined by the helical features 526, the first tapered surface 518, and the second tapered surface 520 can control a rotational amount that the cradle rotor 504 is allowed to displace relative to the sprocket hub 502 in response to a given axial displacement input applied to the spider rotor 504. Thus, independent of the engine speed and cam torque pulse magnitude, the present invention provides systems and methods for accurately controlling an axial position of a first component (e.g., the spider rotor 406) with a mechanism causing a second component (e.g., the cradle rotor 404), which can be coupled to the cam shaft or crank shaft, to rotationally displace a predetermine amount in response to the axial displacement of the first component to alter a rotational relationship between a cam shaft and a crank shaft on an internal combustion engine.

As described above, alternative configurations are possible for the relative rotation of the components of the cam phasing systems described herein. That is, in some embodiments, the cam phasing systems described herein can enable a spider rotor to be rotated relative to a sprocket hub (e.g., the cam phasing system 10, 100, 200, 300, and 400) to alter a rotational relationship between a cam shaft and a crank shaft on an internal combustion engine. In other embodiments, the cam phasing systems described herein can enable a spider rotor to be displaced axially relative to a sprocket hub (e.g., that cam phasing system 600) to alter a rotational relationship between a cam shaft and a crank shaft on an internal combustion engine. It should be appreciated that, in some embodiments, the operation of the cradle rotor and the sprocket hub may be reversed. That is, in some cam phasing systems within the scope of the present disclosure, a spider rotor can be configured to rotate, or axially displace, relative to a cradle rotor, as opposed to a sprocket hub. FIGS. 34-37 show one such cam phasing system 600 according to still another embodiment of the present invention.

As shown in FIGS. 34-37, the cam phasing system 600 can include a sprocket hub 602, a cradle rotor 604, a spider rotor 606, a helix rod 608, an end plate 610, and a plurality of locking assemblies 611. The sprocket hub 602, the cradle rotor 604, the spider rotor 606, the helix rod 608, and an end plate 610 can each share a common central axis 612, when assembled. The sprocket hub 602 can be configured to be coupled to a crank shaft of an internal combustion engine, for example, via a belt, chain, or gear train assembly. The sprocket hub 602 can define a generally annular shape and can include a central hub 614 extending axially from a front surface 616 thereof. The central hub 614 can include a mounting surface 618 having a plurality of mounting apertures 620 arranged circumferentially around the mounting surface 618. The central hub 614 can define an inner bore 622 including a plurality of locking surfaces 624 arranged circumferentially around the inner bore 622. The illustrated plurality of locking surfaces 624 can each define a generally flat surface that, when assembled, can be arranged around a central hub 626 of the cradle rotor 604.

Figure 37:
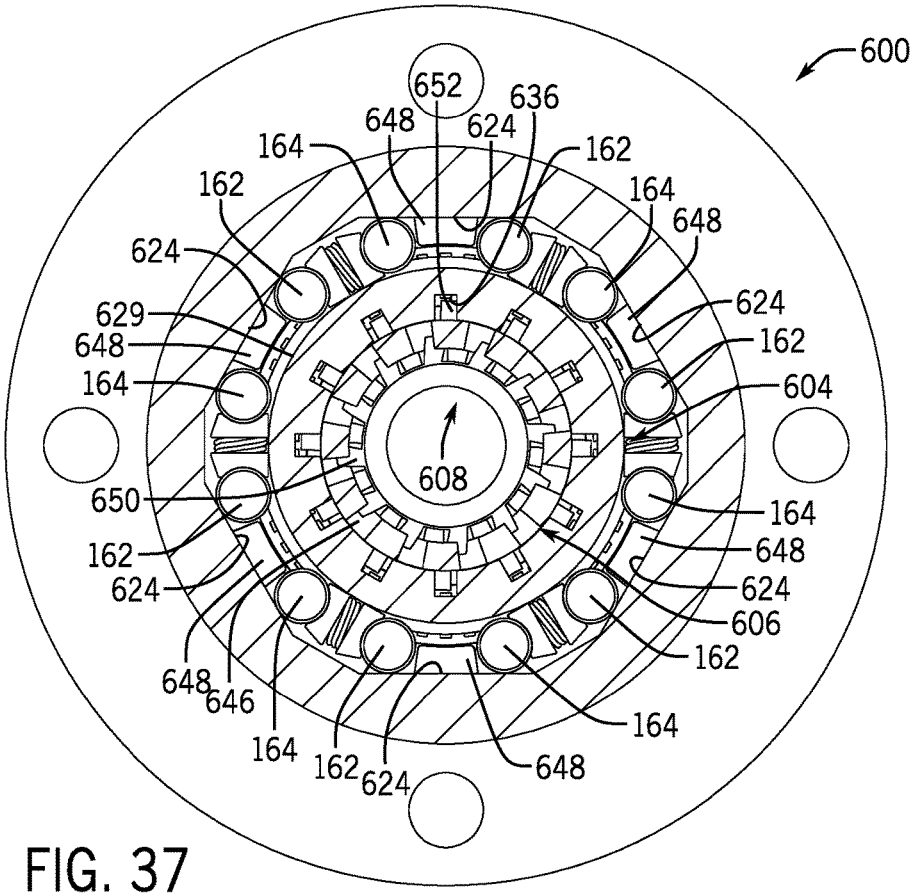
FIG. 37 is a back view of the cam phasing system of FIG. 34 with a back wall of a sprocket hub transparent.

The central hub 626 of the cradle rotor 604 can define a generally annular shape and can protrude axially from a front surface 628 of the cradle rotor 604. The central hub 626 can include a locking surface 629 that can defines a generally round, or circular, shape in cross-section and is configured to engage the plurality of locking assemblies 611. Each of the plurality of locking surfaces 624 of the sprocket hub 602 can be arranged to be substantially tangent to the locking surface 629 of the cradle rotor 604, as shown in FIG. 37. A corresponding one of the plurality of locking assemblies 611 is configured to be arranged between the locking surface 629 of the cradle rotor 604 and a corresponding one of the plurality of locking surfaces 624 of the sprocket hub 602.

A mounting plate 630 can be arranged within an inner bore 632 defined by the central hub 626. The mounting plate 630 can include a plurality of mounting apertures 634 configured to enable the cam shaft to be fastened to the cradle rotor 604. The inner bore 632 can extend axially through the cradle rotor 604 and can include a plurality of slots 636 arranged circumferentially around the inner bore 632. Each of the plurality of slots 636 can define a radial recess in the inner bore 632 that extends axially in a direction substantially parallel to the central axis 612. Each of the plurality of slots 636 can extend axially from a first end 638 of the cradle rotor 604 to a location between the first end 638 and a second end 640 of the cradle rotor.

The spider rotor 606 can include a central hub 642 extending axially outward from a front surface 644 thereof. The central hub 642 can include a plurality of helical features 646 arranged circumferentially around the central hub 642. In the illustrated non-limiting example, the plurality of helical features 646 can each define a radially recessed cutout in the central hub 646, which define a helical profile as they extend axially along the central hub 642.

A plurality of arms 648 can extend axially from a periphery of the front surface 644 in the same direction as the central hub 642. The plurality of arms 648 can be arranged circumferentially around the periphery of the front surface 644. The illustrated spider rotor 606 can include six arms 648 arranged in approximately 60 degree increments around the periphery of the front surface 644. In other embodiments, the spider rotor 606 may include more or less than six arms 648 arranged circumferentially in any increment around the periphery of the front surface 644, as desired. The plurality of arms 648 can be spaced circumferentially around the periphery of the front surface 644 such that a gap can exist between adjacent arms 648. Each gap can be dimensioned such that a corresponding one of a plurality of locking assemblies 611 can be arranged therein, as shown in FIG. 37.

The illustrated locking assemblies 611 can be similar in design and functionality to the locking assemblies 160, described above, with similar components identified using liker reference numerals. In other embodiments, the locking assemblies 611 may be similar to the locking assemblies 20, described above. In still other embodiments, the locking assembles 611 may be in the form of wedged features, for example, as described above with reference to FIG. 18.

The helix rod 608 can define a generally annular shape and can include a plurality of helical splines 650 extending radially outward therefrom. Each of the plurality of helical splines 650 can be configured to be received within a corresponding one of the plurality of helical features 646 on the central hub 642 of the spider rotor 606, when assembled. Each of the plurality of helical splines 650 can include a post 652 extending radially outward therefrom. Each of the plurality of posts 652 can be configured to be received within a corresponding one of the plurality of slots 636 on the inner bore 632 of the cradle rotor 604. Thus, the illustrated helix rod 608 is configured to interact with both the cradle rotor 604 and the spider rotor 606 in response to an axial force applied thereto (e.g., via an actuation mechanism coupled thereto).

Figure 36:
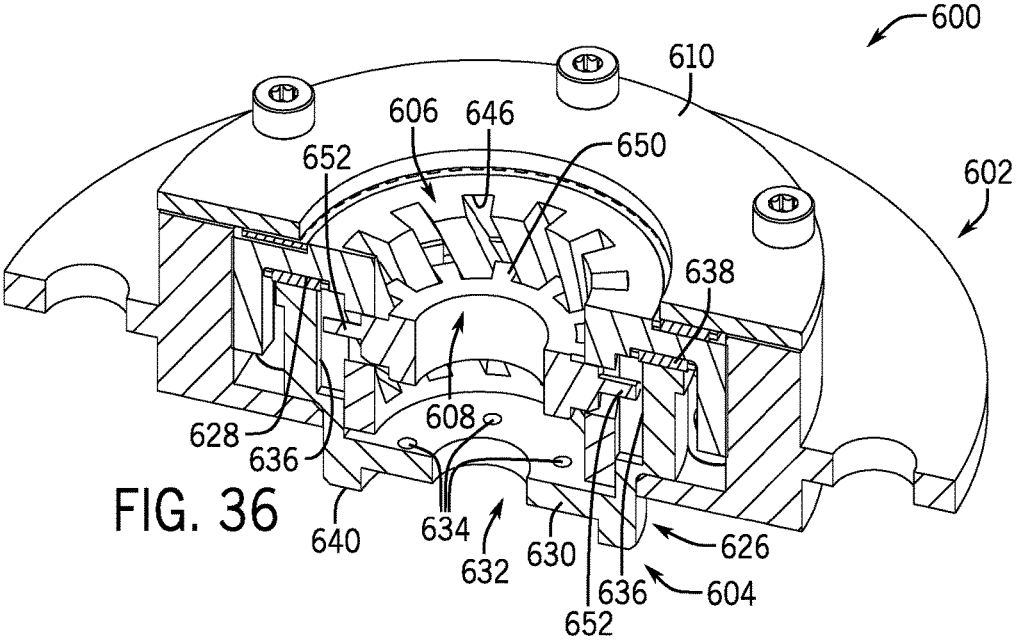
FIG. 36 is a cross-sectional view of the cam phasing system of FIG. 34 taken along line 36-36.

The end plate 610 defines a generally annular shape and includes a central aperture 654 and a plurality of mounting apertures 656 arranged circumferentially around a periphery thereof. The central aperture 654 can be dimensioned to enable an actuation mechanism extend therethrough a couple to the helix rod 608. Each of the plurality of mounting apertures 656 can be arranged to align with a corresponding one of the plurality of mounting apertures 620 on the mounting surface 618 of the sprocket hub 602. This can enable the end plate 610 to be fastened to the sprocket hub 602 and axially constrain the cradle rotor 604 and the spider rotor 606 within the inner bore 622 defined by the sprocket hub 602, when assembled, as shown in FIG. 36.

Operation of the cam phasing system 600 when altering a rotational relationship between the cam shaft and the crank shaft can be similar to the operation of the cam phasing system 100, described above, except that the rotational relationship can be reversed. That is, when an axial force can be applied to the helix rod 608 in a desired direction, the helix rod 608 can displace axially in the desired direction and cause the spider rotor 608 to rotate relative to the cradle rotor 604. This can be caused by an interaction between the helical splines 650 of the helix rod 608 and the helical features 646 of the spider rotor 606, and an interaction between the posts 652 of the helix rod 608 and the slots 636 of the cradle rotor 604, as the helix rod 608 is displaced axially. The rotation of the spider rotor 608 can cause the arms 648 to unlock a one of the first and second locking features 162 and 164 of the locking assemblies 611, similar to the operation of the cam phasing system 100, described above. However, for the cam phasing system 600, the unlocking of the locking assemblies 611 enables the sprocket hub 602, as opposed to the cradle rotor 604, to follow the rotational position of the spider rotor 608. This can be achieved by the locking surfaces 624 being arranged on the sprocket hub 602 and locking surface 629 defining a substantially circular cross-section, as shown in FIG. 37.

Thus, independent of the engine speed and cam torque pulse magnitude, the present invention provides systems and methods for accurately controlling a rotary position of a first component (e.g., the spider rotor 606) with a mechanism causing a second component (e.g., the sprocket hub 602), which can be coupled to the cam shaft or crank shaft, to follow the rotary position of the first component to alter a rotational relationship between a cam shaft and a crank shaft on an internal combustion engine.

Figure 38:
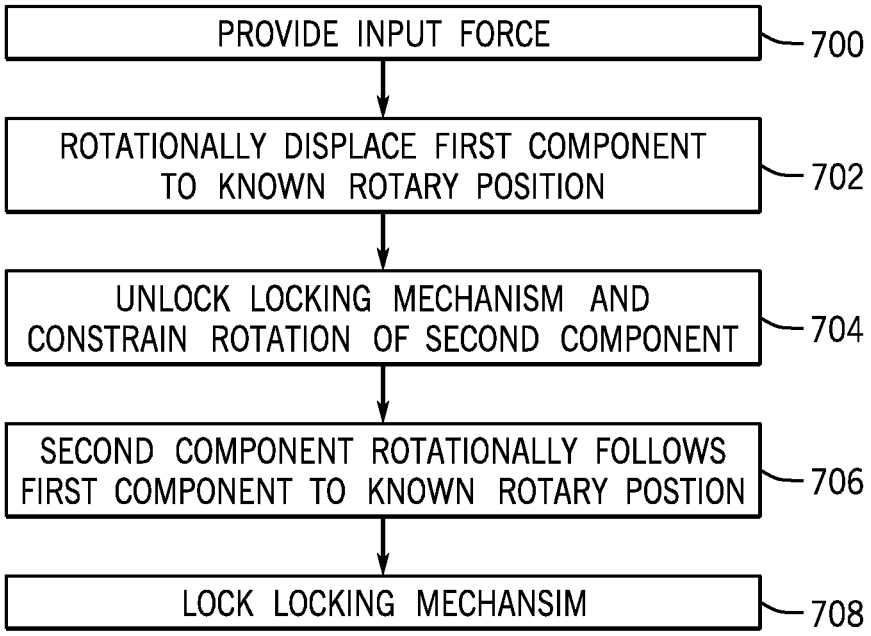
FIG. 38 is a flowchart illustrating steps for altering a rotational relationship between a cam shaft and a crank shaft on an internal combustion engine according to one aspect of the present invention.
Figure 39:
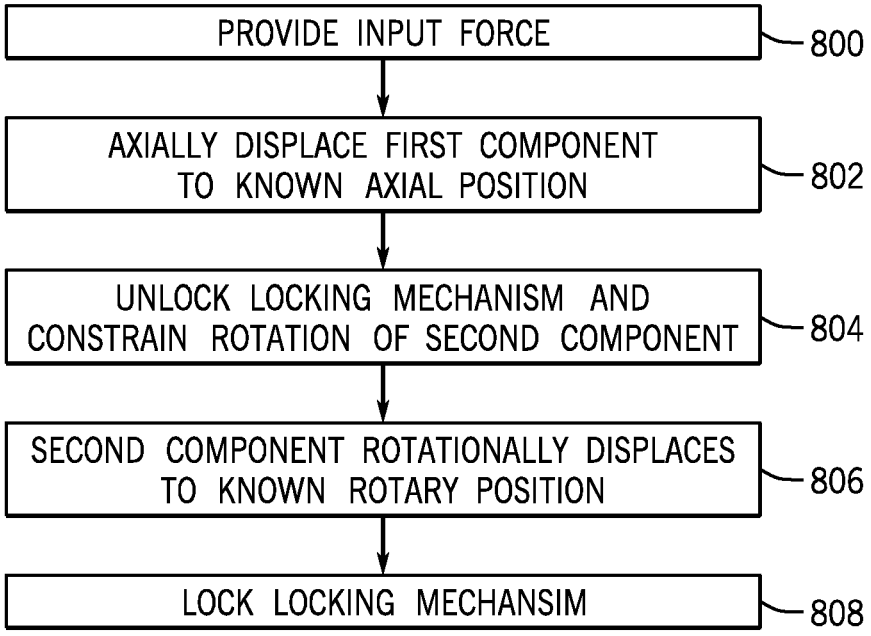
FIG. 39 is a flowchart illustrating steps for altering a rotational relationship between a cam shaft and a crank shaft on an internal combustion engine according to another aspect of the present invention.

The numerous non-limiting examples, described above, illustrate the designs and configurations of cam phasing systems that enable a rotational relationship between a cam shaft and a crank shaft on an internal combustion engine to be altered independent of the engine speed and cam torque pulse magnitude. One of skill in the art would appreciate that other designs and configurations may be possible to achieve the general approach provided by the cam phasing systems described herein. FIGS. 38 and 39 further illustrate a general approach provided by the systems and methods described herein.

FIG. 38 illustrates one non-limiting approach for altering a rotational relationship between a cam shaft and a crank shaft on an internal combustion engine. Initially, at step 700, an input displacement can be provided to a cam phasing system. The input displacement can be provided via an actuation mechanism (e.g., a linear actuator, or a solenoid). In response to the input displacement provided at step 700, a first component (e.g., one of the spider rotors 18, 106, 206, 406 or 606 described herein) can be forced to rotate, relative to a third component (e.g., one of the sprocket hubs 12, 102, 202, or 402 described herein or the cradle rotor 604), to a known rotary position, at step 702. In some embodiments, the third component can be coupled to the crank shaft of the internal combustion engine. In other embodiments, the third component can be coupled to the cam shaft of the internal combustion engine.

Once the first component begins to rotate at step 702, a locking mechanism (e.g., one of the locking mechanisms 20 or 160 described herein) can unlock a first locking feature while a second locking feature remains locked, at step 704. Simultaneously, since the second locking feature remains locked, a second component (e.g., one of the cradle rotors 14, 104, 204, 404, 504 described herein or the sprocket hub 602) can be constrained to only follow the first component (i.e., only rotate in the same direction in which the first component was rotated). The unlocking of the first locking feature can enable the second component to rotationally follow the first component to the known rotary position, at step 706. In some embodiments, the second component can be coupled to the cam shaft of the internal combustion engine. In other embodiments, the second component can be coupled to the crank shaft of the internal combustion engine. As the second component rotationally follows the first component, the second component can rotate relative to the third component, which, in turn, alters a rotational relationship between the cam shaft and the crank shaft of the internal combustion engine.

The second component can be allowed to continue to rotate until it reaches the known rotary position defined by the rotation of the first component (i.e., a known rotational offset with respect to the third component). Once the second component reaches the desired known rotary position, the locking mechanism can again lock the first locking feature, at step 708, to rotationally lock the second component relative to the third component. The above-described process can be repeated, as desired, for subsequent changes in the rotational relationship between the cam shaft and the crank shaft.

FIG. 39 illustrates another non-limiting approach for altering a rotational relationship between a cam shaft and a crank shaft on an internal combustion engine. Initially, at step 800, an input displacement can be provided to a cam phasing system. The input displacement can be provided via an actuation mechanism (e.g., a linear actuator, or a solenoid). In response to the input displacement provided at step 800, a first component (e.g., the spider rotors 506) can be forced to axially displace, relative to a third component (e.g., the sprocket hub 502), to a known axial position, at step 802. In some embodiments, the third component can be coupled to the crank shaft of the internal combustion engine.

Once the first component begins to displace at step 802, a locking mechanism (e.g., the locking wedges 508 and 510) can unlock a first locking feature while a second locking feature remains locked, at step 804. Simultaneously, since the second locking feature remains locked, a second component (e.g., the cradle rotor 504) can be constrained to only rotate in a desired direction. The unlocking of the first locking feature can enable the second component to rotationally displace in the desired direction a known rotary position, at step 806. In some embodiments, the second component can be coupled to the cam shaft of the internal combustion engine. As the second component rotationally follows the first component, the second component can rotate relative to the third component, which, in turn, alters a rotational relationship between the cam shaft and the crank shaft of the internal combustion engine.

The second component can be allowed to continue to rotate until it reaches the known rotary position defined by the axial displacement of the first component. Once the second component reaches the desired known rotary position, the locking mechanism can again lock the first locking feature, at step 808, to rotationally lock the second component relative to the third component. The above-described process can be repeated, as desired, for subsequent changes in the rotational relationship between the cam shaft and the crank shaft.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A cam phasing system comprising:

a sprocket hub including a gear and a sprocket sleeve received within the sprocket hub;

a cradle rotor at least partially received within the sprocket hub and configured to rotate relative to the sprocket hub;

a plurality of locking assemblies arranged circumferentially around and radially between the sprocket sleeve and the cradle rotor; and a spider rotor at least partially received within the sprocket hub and configured to rotate to a known rotary position relative to the sprocket hub in response to an input displacement applied thereto;

whereby rotation of the spider rotor in a desired direction to the known rotary position unlocks the plurality of locking assemblies, which, in turn, allows the cradle rotor to rotate relative to the sprocket hub and rotationally follow the spider rotor in the desired direction to the known rotary position.

2. The cam phasing system of claim 1, wherein the sprocket sleeve is fabricated from a material with a greater hardness than the sprocket hub.

3. The cam phasing system of claim 1, wherein the plurality of locking assemblies each include a first locking feature and a second locking feature.

4. The cam phasing system of claim 3, wherein rotation of the spider rotor in the desired direction displaces one of the first locking features and the second locking features to an unlocked position and one of the first locking features and the second locking features not displaced by the spider rotor remain in a locked position.

5. The cam phasing system of claim 1, further comprising a helix rod coupled to the spider rotor.

6. The cam phasing system of claim 5, wherein the helix rod includes a plurality of splines defining a helical portion configured to be received within and interact with a plurality of helical features in the spider rotor, and wherein the interaction between the helical portion of the plurality of splines and the plurality of helical features enable the rotation of the spider rotor in the desired direction to the known rotary position in response to the input displacement.

7. A cam phasing system comprising:

a sprocket hub;

a cradle rotor including a central hub and a cradle sleeve received around the central hub;

a plurality of locking assemblies arranged circumferentially around and radially between the cradle sleeve and the sprocket hub; and a spider rotor at least partially received within the sprocket hub and configured to rotate to a known rotary position relative to the sprocket hub in response to an input displacement applied thereto;

whereby rotation of the spider rotor in a desired direction to the known rotary position unlocks the plurality of locking assemblies, which, in turn, allows the cradle rotor to rotate relative to the sprocket hub and rotationally follow the spider rotor in the desired direction to the known rotary position.

8. The cam phasing system of claim 7, wherein the central hub includes at least one tab protruding radially outwardly therefrom, and the cradle sleeve includes at least one slot radially recessed into an inner surface thereof.

9. The cam phasing system of claim 8, wherein the at least one tab is dimensioned to be received within the at least one slot to rotationally interlock the central hub and the cradle sleeve.

10. The cam phasing system of claim 7, wherein the cradle sleeve is fabricated from a material with a greater hardness than the cradle rotor.

11. The cam phasing system of claim 7, wherein the plurality of locking assemblies each include a first locking feature and a second locking feature.

12. The cam phasing system of claim 11, wherein rotation of the spider rotor in the desired direction displaces one of the first locking features and the second locking features to an unlocked position and one of the first locking features and the second locking features not displaced by the spider rotor remain in a locked position.

13. The cam phasing system of claim 7, further comprising a helix rod coupled to the spider rotor.

14. The cam phasing system of claim 13, wherein the helix rod includes a plurality of splines defining a helical portion configured to be received within and interact with a plurality of helical features in the spider rotor, and wherein the interaction between the helical portion of the plurality of splines and the plurality of helical features enable the rotation of the spider rotor in the desired direction to the known rotary position in response to the input displacement.

15. A cam phasing system comprising:

a sprocket hub including an inner surface;

a cradle rotor including a central hub and at least partially received within the sprocket hub;

a sleeve at least partially received within the sprocket hub and arranged radially between the inner surface of the sprocket hub and the central hub of the cradle rotor;

a plurality of locking assemblies circumferentially spaced and in engagement with the sleeve; and a spider rotor at least partially received within the sprocket hub and configured to rotate to a known rotary position relative to the sprocket hub in response to an input displacement applied thereto;

whereby rotation of the spider rotor in a desired direction to the known rotary position unlocks the plurality of locking assemblies, which, in turn, allows the cradle rotor to rotate relative to the sprocket hub and rotationally follow the spider rotor in the desired direction to the known rotary position.

16. The cam phasing system of claim 15, wherein the sleeve is in engagement with the inner surface of the sprocket hub.

17. The cam phasing system of claim 15, wherein the sleeve is in engagement with the central hub.

18. The cam phasing system of claim 15, wherein the central hub includes at least one tab protruding radially outwardly therefrom, and the sleeve includes at least one slot radially recessed into a sleeve inner surface thereof.

19. The cam phasing system of claim 18, wherein the at least one tab is dimensioned to be received within the at least one slot to rotationally interlock the cradle rotor and the sleeve.

20. The cam phasing system of claim 15, further comprising a helix rod coupled to the spider rotor, wherein the helix rod includes a plurality of splines defining a helical portion configured to be received within and interact with a plurality of helical features in the spider rotor, and wherein the interaction between the helical portion of the plurality of splines and the plurality of helical features enable the rotation of the spider rotor in the desired direction to the known rotary position in response to the input displacement.

* * * * *